US007032330B2

(12) United States Patent
Adams et al.

(10) Patent No.: US 7,032,330 B2
(45) Date of Patent: Apr. 25, 2006

(54) GRIND RAIL APPARATUS

(75) Inventors: Roger R. Adams, The Colony, TX (US); Michael G. Staffaroni, Dallas, TX (US)

(73) Assignee: Heeling Sports Limited, Carrollton, TX (US)

( * ) Notice: Subject to any disclaimer, the term of this patent is extended or adjusted under 35 U.S.C. 154(b) by 140 days.

(21) Appl. No.: 10/357,998

(22) Filed: Feb. 3, 2003

(65) Prior Publication Data

US 2003/0145493 A1 Aug. 7, 2003

Related U.S. Application Data

(60) Provisional application No. 60/353,746, filed on Feb. 1, 2002.

(51) Int. Cl.
*A43B 5/00* (2006.01)
*A43B 13/22* (2006.01)
*A43B 13/24* (2006.01)

(52) U.S. Cl. ..... 36/115; 36/132; 36/114; 36/107; 36/72 A; 36/149; 36/136; 36/75 R

(58) Field of Classification Search ..... 36/132, 36/115, 114, 107, 72 A, 73, 108, 25 R, 148, 36/149, 152, 103, 116, 133, 136, 7.1 R, 76 R, 36/76 C, 72 R, 72 B, 75 R, 75 A, 82
See application file for complete search history.

(56) References Cited

U.S. PATENT DOCUMENTS 132,474 A 10/1872 Lindley
202,191 A 4/1878 Proctor
234,030 A 11/1880 Hadley et al.
487,779 A 12/1892 Schoen
579,577 A 3/1897 Hanscom
702,476 A 6/1902 Price
875,560 A 12/1907 Vaughan
881,079 A 3/1908 Jolitz
892,152 A 6/1908 Harman
966,821 A 8/1910 Gaw
968,020 A 8/1910 Yandoli
1,051,880 A 2/1913 Glenn
1,056,091 A 3/1913 Dickson
1,189,329 A 7/1916 Winagle
1,260,901 A 3/1918 Hayhurst
1,428,232 A 9/1922 Holmen
1,502,087 A 7/1924 Bunns
1,592,692 A 7/1926 Hackett (Continued)

FOREIGN PATENT DOCUMENTS

AU DES. 137579 6/1999

(Continued)

OTHER PUBLICATIONS

Pending U.S. Appl. No. 10/071,931 entitled "Heeling Apparatus and Method" filed Feb. 7, 2002, Inventor: Roger R. Adams.

(Continued)

*Primary Examiner*—Anthony Stashick
(74) *Attorney, Agent, or Firm*—Robert J. Ward

(57) ABSTRACT

A grind rail apparatus coupleable to an underside of a footwear for grinding is provided. The grind rail apparatus includes a body having an upper side and a lower side, the upper side of the body coupled to the underside of the footwear. The grind rail apparatus also includes a plurality of rails extending from the lower side of the body.

12 Claims, 15 Drawing Sheets

U.S. PATENT DOCUMENTS 1,636,909 A 7/1927 Haney
1,690,696 A 11/1928 Norwood
1,702,591 A 2/1929 Brown
1,866,006 A 7/1932 Bergstrand
1,888,617 A 11/1932 Bridi
1,984,989 A 12/1934 Reed
1,998,624 A 4/1935 Hughes
2,060,391 A 11/1936 Castagnola
2,113,477 A 4/1938 Gilman
2,114,461 A 4/1938 Agosta et al.
2,114,790 A 4/1938 Venables
2,138,823 A 12/1938 Werkman
2,165,581 A 7/1939 Schroeder
D117,918 S 12/1939 Brodick
2,466,611 A 4/1949 Nicoletti
2,476,806 A 7/1949 Brandt, Jr.
2,484,935 A 10/1949 De Rooy
2,490,469 A 12/1949 Pittman
2,572,671 A 10/1951 Shaw
2,582,551 A 1/1952 Malherbe
2,632,964 A 3/1953 Kriegel
2,669,038 A 2/1954 Werth
2,721,400 A 10/1955 Israel
2,723,467 A 11/1955 Cassidy
2,897,609 A 8/1959 Bodkin
3,027,661 A 4/1962 McCord
3,032,894 A 5/1962 Kennedy et al.
3,176,416 A 4/1965 Seegert
3,478,447 A 11/1969 Gillead
3,486,250 A 12/1969 Purtle
3,665,621 A 5/1972 Massella
3,789,523 A 2/1974 Rubin
3,934,359 A 1/1976 Fletcher
4,214,384 A 7/1980 Ricardo
4,223,457 A 9/1980 Borgeas
4,245,406 A 1/1981 Landay et al.
4,316,334 A 2/1982 Hunt
4,492,046 A 1/1985 Kosova
4,496,025 A 1/1985 Gattman
4,638,575 A 1/1987 Illustrato
4,676,010 A 6/1987 Cheskin
4,763,909 A 8/1988 Bergeron
4,783,910 A 11/1988 Boys, II et al.
4,815,221 A 3/1989 Diaz
4,841,648 A 6/1989 Shaffer et al.
4,843,737 A 7/1989 Vorderer
4,843,741 A 7/1989 Yung-Mao
4,897,939 A 2/1990 Harrington
4,947,560 A 8/1990 Fuerst et al.
4,977,691 A 12/1990 Orchard, 3rd
5,005,300 A 4/1991 Diaz
5,056,240 A 10/1991 Sherrill
5,060,401 A 10/1991 Whatley
5,134,791 A 8/1992 Gregory
5,195,257 A 3/1993 Holcomb et al.
5,224,278 A 7/1993 Jeon
5,249,376 A 10/1993 Capria
5,282,325 A 2/1994 Beyl
5,319,866 A 6/1994 Foley et al.
5,319,869 A 6/1994 McDonald
D352,818 S 11/1994 Bailey
5,363,570 A 11/1994 Allen et al.
5,373,649 A 12/1994 Choi
5,381,608 A 1/1995 Claveria
5,384,973 A 1/1995 Lyden
5,392,537 A 2/1995 Goldberg
5,396,675 A 3/1995 Vincent et al.
5,410,821 A 5/1995 Hilgendorf
5,419,060 A 5/1995 Choi
5,425,186 A 6/1995 Hoyt
5,502,901 A 4/1996 Brown
5,519,950 A 5/1996 Wang
5,544,431 A 8/1996 Dixon
D373,674 S 9/1996 Dolinsky
5,572,804 A 11/1996 Skaja
5,595,004 A 1/1997 Lyden et al.
5,632,104 A 5/1997 Zohar
5,638,614 A 6/1997 Hardy
5,649,374 A 7/1997 Chou
5,655,316 A 8/1997 Huang
5,682,685 A 11/1997 Terlizzi
5,692,322 A 12/1997 Lombardino
5,716,723 A 2/1998 Van Cleef et al.
5,743,028 A 4/1998 Lombardino
5,836,591 A 11/1998 Roderick
D401,739 S 12/1998 James
D404,550 S 1/1999 James
5,881,413 A 3/1999 Throneburg et al.
5,885,500 A 3/1999 Tawney et al.
D408,123 S 4/1999 James
5,927,729 A 7/1999 Di Filippo et al.
D412,778 S 8/1999 James
D412,779 S 8/1999 James
D413,193 S 8/1999 James
5,930,918 A 8/1999 Healy et al.
D414,021 S 9/1999 James
D414,320 S 9/1999 Brent
5,967,552 A 10/1999 Roderick et al.
5,970,631 A 10/1999 Inman
6,006,449 A 12/1999 Orlowski et al.
6,006,450 A 12/1999 Hayes
6,006,451 A 12/1999 Morris et al.
D420,789 S 2/2000 James
6,041,525 A 3/2000 Kelley
6,055,747 A 5/2000 Lombardino
6,061,930 A 5/2000 Zinovieff
D426,374 S 6/2000 Kelley
D426,948 S 6/2000 James
6,092,305 A 7/2000 Troy et al.
6,115,943 A 9/2000 Gyr
6,115,946 A 9/2000 Morris et al.
D433,214 S 11/2000 McDowell
6,151,806 A 11/2000 Morris et al.
6,158,150 A 12/2000 Morris et al.
6,195,918 B1 3/2001 Kelley et al.
6,195,920 B1 3/2001 Morris et al.
D440,386 S 4/2001 James
6,213,480 B1 4/2001 Rodriguez
6,226,900 B1 5/2001 Mazars
6,243,972 B1 6/2001 De France
6,247,251 B1 6/2001 James
6,357,145 B1 3/2002 James
6,406,038 B1 6/2002 Adams
6,450,509 B1 9/2002 Adams
6,467,198 B1 10/2002 James
6,581,943 B1 6/2003 Wegener ..... 280/11.221
6,698,769 B1 3/2004 Adams et al.
6,751,891 B1 6/2004 Lombardino
6,764,082 B1 7/2004 Roderick
2003/0127811 A1 7/2003 Adams
2003/0150133 A1 8/2003 Staffaroni et al.

FOREIGN PATENT DOCUMENTS

CA 1138194 12/1982
CA 1239017 7/1988
CN DES. ZL98300231.2 1/1998
DE 309567 3/1918
DE 20023053.0 10/2002
FR 1194886 11/1959
GB 117176 7/1918
GB 150512 9/1920
GB 216903 1/1925
GB 2363562 3/2000

| | | |
|---|---|---|
| IT | 666436 | 8/1964 |
| JP | 17-3781 | 3/1942 |
| JP | 7-79804 | 3/1995 |
| TW | NI-107638 | 7/1986 |
| WO | WO 98/01051 | 1/1998 |

OTHER PUBLICATIONS

Pending U.S. Appl. No. 10/071,597 entitled "Heeling Apparatus and Method" filed Feb. 7, 2002, Inventor: Roger R. Adams.

Pending U.S. Appl. No. 10/076,954 entitled "Heeling Apparatus and Method" filed Feb. 15, 2002, Inventor: Roger R. Adams.

U.S. Appl. Publ. No. 2003/0155725 A1, published Aug. 21, 2003; entitled *Shoes for Walking and Rolling;* inventor: John A. Roderick; U.S. Appl. No. 10/081,388 filed Feb. 20, 2002.

U.S. Appl. Publ. No. 2004/0212160 A1, published Oct. 28, 2004; entitled *Shoes for Walking and Rolling;* inventor: John A. Roderick; U.S. Appl. No. 10/847,242 filed May 17, 2004.

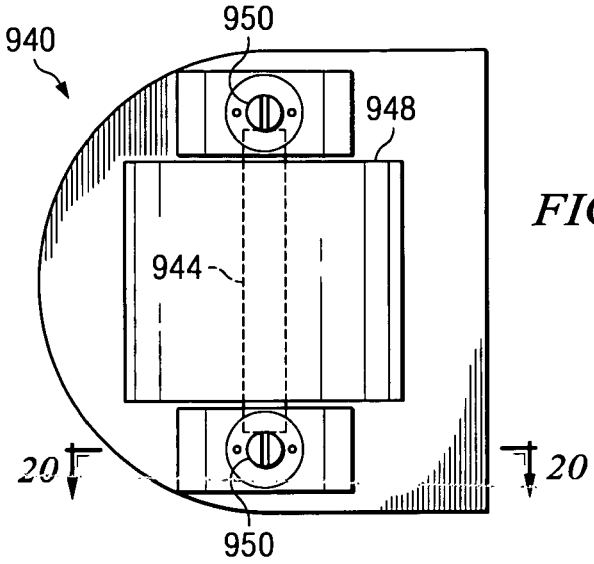
FIG. 19
FIG. 20
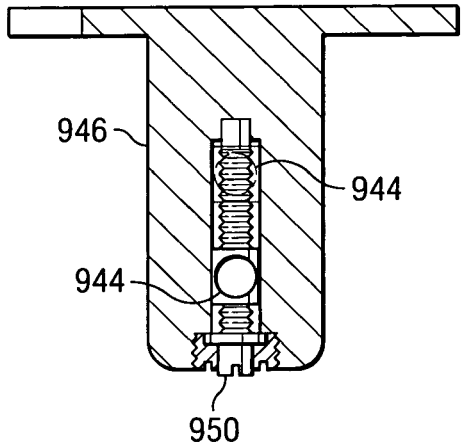
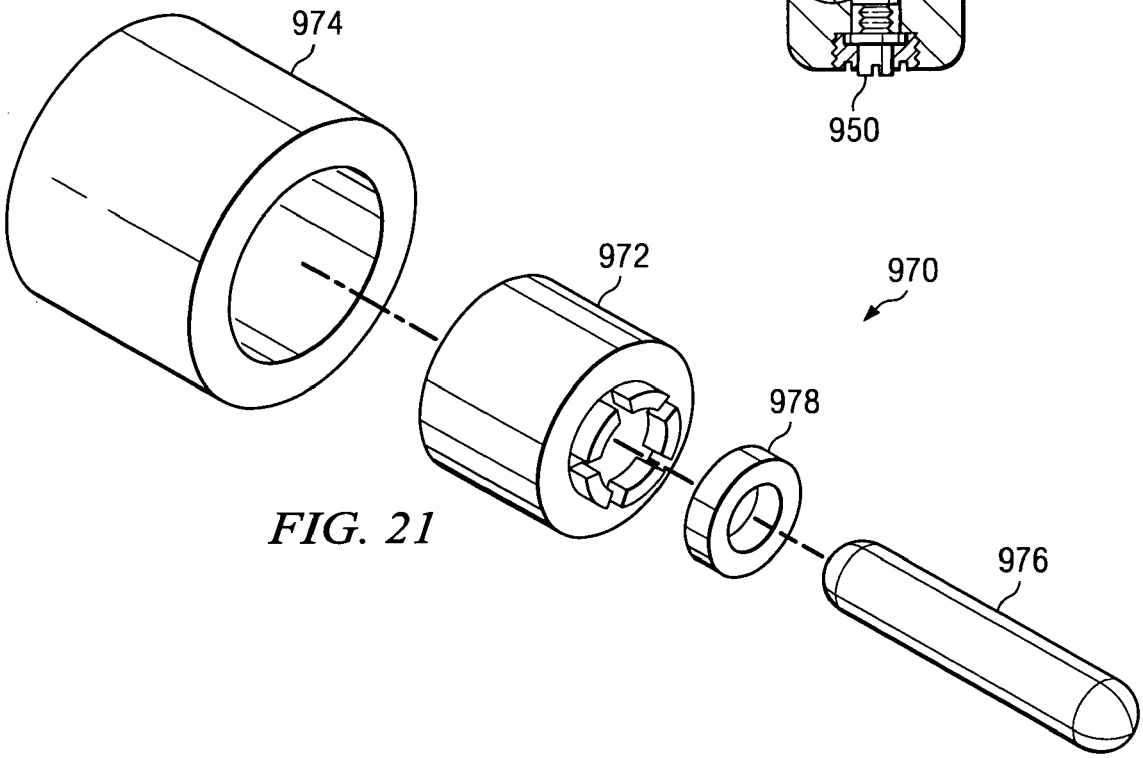
FIG. 21

GRIND RAIL APPARATUS

CROSS-REFERENCE TO RELATED APPLICATIONS

Pursuant to 35 U.S.C. § 119(e), this application claims the benefit of U.S. Provisional Patent Application No. 60/353,746, entitled Grind Rail Apparatus, filed Feb. 1, 2002, naming Roger R. Adams and Michael G. Staffaroni as inventors, which is hereby incorporated by reference for all purposes.

TECHNICAL FIELD OF THE INVENTION

This invention relates in general to the field of sliding footwear for sliding on certain surfaces and more particularly, but not by way of limitation, to a grind rail apparatus for grinding on, for example, rails, pipes and other edged surfaces.

BACKGROUND OF THE INVENTION

Footwear has evolved significantly in recent years. Footwear is available for almost every imaginable use and activity, particularly athletic footwear for sporting activities. Skateboarders pioneered a sliding or grinding technique whereby the skateboarder engaged the underside of the skateboard on a support surface such as a sidewalk curb or pipe handrail and would slide thereon for extended distances.

Grinding became so popular that footwear was developed having a slick hardened underside instead of the conventional rubber, tractional, surface ordinarily associated with athletic footwear, such as tennis shoes. The wearer could more effectively slide or grind using footwear with a slick hardened underside. Also, grind plates were used that provided a large surface area on which to slide. However, control while sliding and grinding has always been problematic.

Grind plates having a concave surface adapted to receive, for example, a pipe of a handrail have been used to provide the wearer increased control while grinding on particular surfaces. However, grind plates with a specific configuration adapted for one particular grinding surface have significant limitations and do not lend themselves to enjoyment on a variety of surfaces.

For this reason, a need exists for an improved grinding apparatus that overcomes the disadvantages of previous grinding devices.

SUMMARY OF THE INVENTION

From the foregoing it may be appreciated that a need has arisen for a grind rail apparatus useful for grinding.

According to an aspect of the present invention, a footwear is provided having a grind rail apparatus disposed on an underside of the footwear for grinding. The grind rail apparatus includes a body having an upper side and a lower side, the upper side of the body coupled to the underside of the footwear. The grind rail apparatus also includes a plurality of rails extending from the lower side of the body.

In other aspects the grind rail apparatus includes at least a first channel disposed between a first rail and a second rail. In one aspect, the plurality of rails extend longitudinally along the underside of the sole of the footwear and the at least first channel extends longitudinally along the underside of the sole of the footwear between the first and second rail.

In one aspect, the upper side of the body is a substantially flat surface extending from a first side to a second side of the body. In other aspects, the upper side of the body may be further defined as substantially convex and arcuate from the first side to the second side of the body.

In one aspect, the grind rail apparatus is formed as a substantially unitary member and may be constructed from, for example, a substantially rigid polymeric material. In this aspect, particularly when the grind rail apparatus is constructed, for example, by an injection molding process, the plurality of rails may be formed from the lower side of the body.

In one aspect, the grind rail apparatus is attached to a portion of the underside of the footwear and in other aspects, the grind rail apparatus is coupled to the sole of the footwear. In yet another aspect, the grind rail apparatus is further defined as sized to be received in an arch portion of the footwear. In this aspect, the grind rail apparatus is disposed between a heel portion of the sole of the footwear and a forefoot portion of the sole of the footwear.

In one aspect the body is provided with a first side and a second side extending between the upper and lower sides. In one aspect, the first and second sides are substantially perpendicular relative to the upper and lower sides. In other aspects, however, the first and second sides may be angled relative to the upper and lower sides. In one aspect, at least the first side is angled inwardly as the first side extends from the upper side toward the lower side.

In yet another aspect, the grind rail apparatus includes an inner compartment within the body between the upper side and lower side, the inner compartment adapted to retain a resilient material to absorb shock.

In one aspect, the present invention is directed to a grind rail apparatus for use on a footwear. The grind rail apparatus includes a body having an upper side and a lower side, the upper side of the body couplable to the underside of the footwear. A plurality of rails are also provided that extend from the lower side of the body.

In one aspect, the rails are further defined as having an upper side and a lower side, the upper side of the rails coupled to the lower side of the body. The lower side of the rails are defined as a substantially flat surface in some aspects, while in other aspects, the lower side of the rails are defined as rounded.

In one aspect, the present invention of the grind rail apparatus for use on a footwear further includes at least one wheel provided on the sole of the footwear and operative for rolling.

In yet another aspect, the present invention provides a method of manufacturing a footwear having a grind rail apparatus on an underside of the footwear. The method includes forming the grind rail apparatus for use on the footwear. The grind rail apparatus includes a body having an upper side and a lower side, the upper side of the body couplable to the underside of the footwear. A plurality of rails are also provided that extend from the lower side of the body.

The method includes constructing the footwear having a sole with a forefoot portion and a heel portion and a recess in an arch portion of the footwear adapted to receive the grind rail apparatus. The arch area is disposed between the forefoot portion and the heel portion of the sole of the footwear. The method provides for coupling the grind rail apparatus to the recess in the arch portion of the footwear.

In one aspect, the method includes that the recess in the arch portion is substantially flat to receive a substantially flat upper side of the body of the footwear therein the recess.

In another aspect, the present invention provides a method of grinding on a surface with a footwear having a grind rail apparatus coupled to the underside of the footwear. The grind rail apparatus includes a body having an upper side and a lower side, the upper side of the body coupled to the underside of the footwear. A plurality of rails extend from the lower side of the body.

The method includes engaging the surface with a first rail of the grind rail apparatus and grinding on the surface a first distance while the first rail engages the surface. The method further includes transitioning to a position wherein the first and a second rails engage the surface and grinding on the surface a second distance while the first and second rails engage the surface.

According to one aspect, the present invention provides a grind rail apparatus for use on a footwear for grinding having a body and a plurality of rails. The body having a substantially flat upper side, a lower side, a front, a back, a first lateral side disposed in a substantially perpendicular relationship with the upper side, a second lateral side disposed in a substantially perpendicular relationship with the substantially flat upper side.

The upper side of the body configured for coupling to an underside of the footwear adjacent an arch portion of the footwear and the lower side of the body substantially arcuate between the front and the back of the body. The plurality of rails coupled to the lower side of the body operable to engage a surface for grinding.

In one aspect, a footwear for ginding is provided that includes a sole having a forefoot portion, an arch portion and a heel portion. The footwear further includes a grind rail apparatus coupled to the arch portion of the footwear. The grind rail apparatus having a body having a substantially flat upper side, a lower side, a first and second lateral sides. The grind rail apparatus further including a plurality of rails coupled to the lower side of the body.

According to one aspect, the footwear is provided with an opening in a heel portion of the sole of the footwear and a wheel operable to roll located in the opening in the heel portion of the sole. In other aspects, a plurality of holes wherein a plurality of wheels are located are provided on the sole of the footwear.

According to another aspect, the present invention is directed to a grind rail apparatus coupled to a footwear for grinding. The grind rail apparatus includes a first member having a substantially flat upper side coupleable to a lower side of the footwear, a lower side provided for grinding, a first lateral side disposed in a substantially perpendicular relationship with the upper side, the first member sized to extend a distance from the lower side of the footwear The grind rail apparatus further includes a second member having a substantially flat upper side coupleable to the lower side of the footwear adjacent the first member, the first member sized such that when the lower side of first member engages a surface for grinding the second member extends a distance above the surface.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 19 is a bottom view that illustrates the wheel assembly of FIG. 18 that further illustrates the dual king pin arrangement;

FIG. 20 is a side view that illustrates one member of the mounting structure that further illustrates the coupling of the axle to the mounting structure using the dual king pin arrangement;

FIG. 21 is a breakaway and perspective view that illustrates a two piece wheel that includes an inner core and an outer tire and that may be used in the present invention;

DETAILED DESCRIPTION OF THE INVENTION

It should be understood at the outset that although an exemplary implementation of the present invention is illustrated below, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

FIGS. 1–21 illustrate various aspects of a heeling apparatus and method as exemplary athletic footwear that may be configured to employ a grind rail apparatus, according to one or more aspects of the present invention. It should be appreciated, however, that the present invention is not limited to implementation on a heeling apparatus and may be utilized on any footwear, with or without wheels, or utilizing one or more wheels all of which are within the spirit and scope of the present invention.

Figure 1:
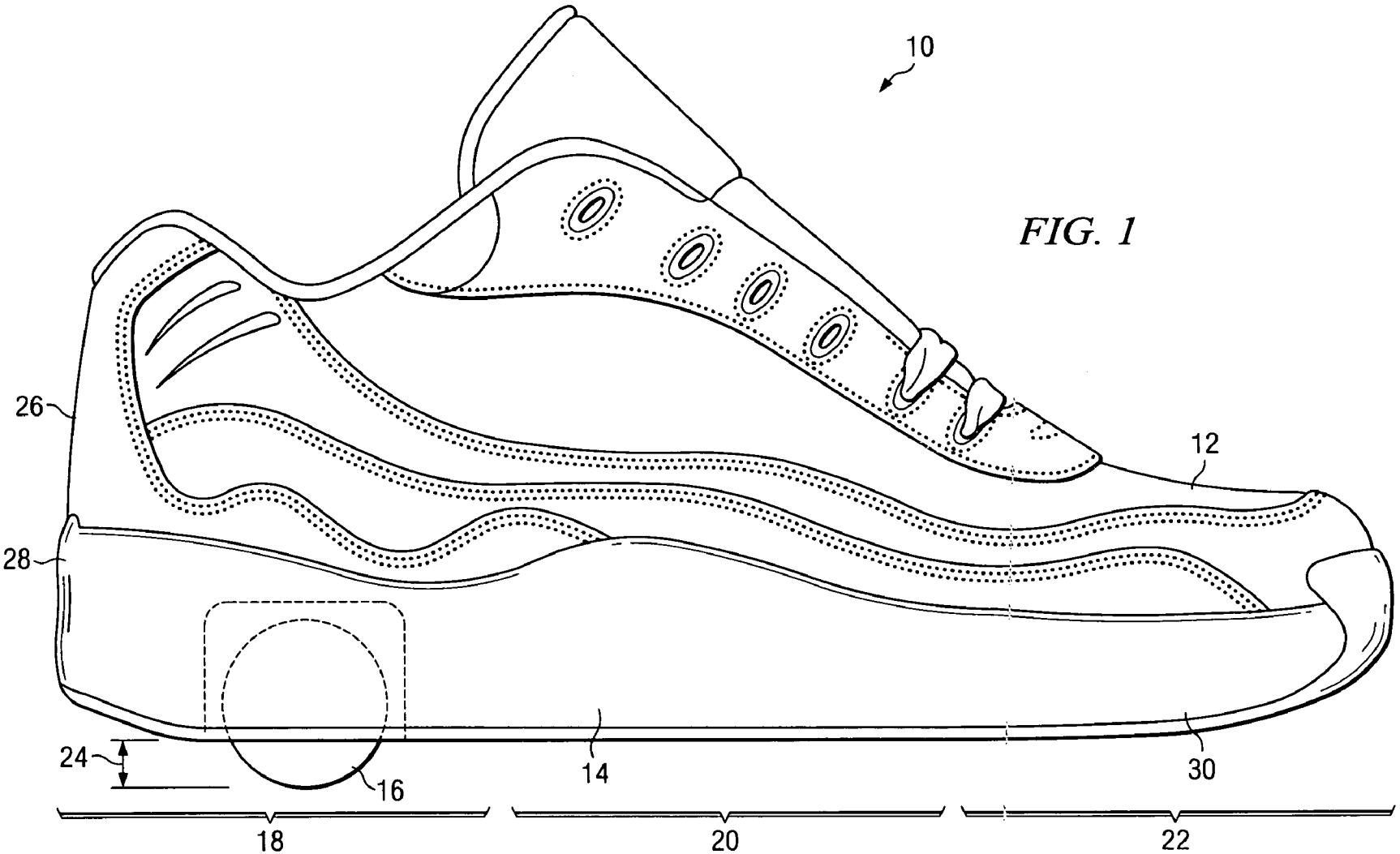
FIG. 1 is a side view that illustrates a heeling apparatus implemented using an athletic shoe according to one embodiment of the present invention.

FIG. 1 is a side view of a heeling apparatus 10 implemented using an athletic shoe 12 according to one embodiment of the present invention. The heeling apparatus 10 preferably includes a wheel assembly provided in an opening in the heel portion of the sole of a footwear. For example the athletic shoe 12 includes an opening in the bottom of a heel portion 18 of a sole 14 with a wheel assembly provided in the hole such that a wheel 16 extends below the bottom of the sole 14. The wheel assembly preferably includes at least one wheel, such as the wheel 16, rotatably mounted on an axle (not illustrated in FIG. 1). The wheel 16 mounted on the axle is preferably positioned in the opening of the sole 14 through a mounting structure (not illustrated in FIG. 1) that is operable to support the axle such that a portion of the wheel 16 extends below the heel portion 18 of the sole 14.

The amount or length of the portion of the wheel 16 that extends below the bottom of the sole 14, as defined by a distance 24, will preferably be less than the diameter of the wheel 16. The distance 24, however, may be greater than, less than, or equal to the diameter of the wheel 16.

The athletic shoe 12, as is true of most footwear, may be generally described as having the sole 14 and an upper part 26. The upper part 26 may be constructed of virtually any material such as, for example, leather, plastic, or canvas. The sole 14 may include three parts: (1) an inner sole or insole (not illustrated in FIG. 1); (2) a midsole 28; and (3) an outer sole or outsole 30. The insole may provide added cushion and may or may not be removable. In some embodiments, the insole may include a removable portion, such as a DR. SCHOLL'S insole, and a portion that remains attached to the athletic shoe 12. The outsole 30 will preferably be made of a durable material, such as rubber, and may have a textured surface, such as with knobbies, to provide added traction. The midsole 28 will generally be constructed of a soft or "cushiony" material and will generally be thicker than the insole and the outsole 30. In some embodiments, however, the sole 14 will comprise only one part, such as the leather sole of a loafer. In other embodiments, the sole 14 may include a separate heel block or object that elevates the footwear, such as the heel of a leather wingtip dress shoe. This heel block or object may be considered to be part of the heel portion 18 of the sole 14. It should be understood that the present invention may be implemented in virtually any footwear, irrespective of the design or the make-up of the sole 14. Various styles of footwear and methods of making footwear are known in the art and are known by one of ordinary skill in the art. For example, U.S. Pat. Nos. 4,245,406, 5,319,869, 5,384,973, 5,396,675, 5,572,804, 5,595,004, and 5,885,500, which are hereby incorporated by reference for all purposes, provide various background information regarding various footwear and methods of making footwear.

In most footwear, including the athletic shoe 12, the sole 14 may also be divided into three portions or regions: (1) the heel portion 18, (2) an arch portion 20, and (3) a forefoot portion 22, as illustrated in FIG. 1. It should be understood that the heel portion 18, the arch portion 20, and the forefoot portion 22 of the sole 14 are incapable of being exactly defined and located, and that such portions vary from one footwear type to another. Thus, the location, the boundaries between, and the size of the heel portion 18, the arch portion 20, and the forefoot portion 22 of the sole 14 are only rough approximations.

It should also be understood that although the position of the opening in the bottom of the sole 14, and hence also the wheel 16, is preferably located in the heel portion 18 of the sole 14, such an opening may also be located at the boundary of the heel portion 18 and the arch portion 20, at the arch portion 20, or at virtually any other location on the sole 14. The opening in the bottom of the sole 14 may extend entirely through the sole 14, e.g., through the outsole, the midsole and the insole, or only partially through the sole 14, e.g., through the outsole, and a portion or all of the midsole.

The wheel 16 may be constructed or made of virtually any known or available material such as, for example, a urethane, a plastic, a polymer, a metal, an alloy, a wood, a rubber, a composite material, and the like. This may include, for example, aluminum, titanium, steel, and a resin. Preferably, the material will be durable, provide quiet performance, and will provide a "soft" or "cushioning" feel. In one embodiment, the wheel 16 may be implemented as one or more precision bearings such that the precision bearing serves as the wheel 16 itself. In yet another embodiment, the wheel assembly may include a spring or suspension such as, for example, a leaf spring, to provide additional cushion or suspension when the wheel 16 contacts a surface and a force is applied to the athletic shoe 12 in the direction of the surface, such as when a someone is wearing and walking in the heeling apparatus 10. The spring is preferably provided as part of the mounting structure of the wheel assembly. In still another embodiment, the wheel 16 is provided as a two piece wheel with an inner core, such as a hard inner core, surrounded by an outer tire, such as a urethane tire.

Depending on the desired implementation, the wheel 16 and the axle may be removable from the wheel assembly. In such a case, a removable cover may be provided in the opening in the sole 14 to cover the opening so that debris and dirt does not enter the opening. The removable cover may be provided in virtually any available configuration readily ascertainable by one of ordinary skill in the art. In one embodiment of the removable cover, an axle portion of the removable cover fits and/or couples to the mounting structure in the same or similar manner that the axle in which the wheel 16 is mounted fits and/or couples to the mounting structure of the wheel assembly. A tool may also be provided to facilitate the removal of the axle and wheel 16. This tool will, preferably, be small and multi-functional to provide any other possible adjustments to the heeling apparatus 10, such as a screw driver, a wrench, and the like. In other embodiments of the heeling apparatus 10, the wheel 16 may be retractable into the opening in the sole 14. In this manner, the wheel 16 may be retracted into the sole 14 and, thus, will not extend below the bottom of the sole 14. This allows the heeling apparatus 10 to function just like ordinary footwear, such as the athletic shoe 12.

Figure 13:
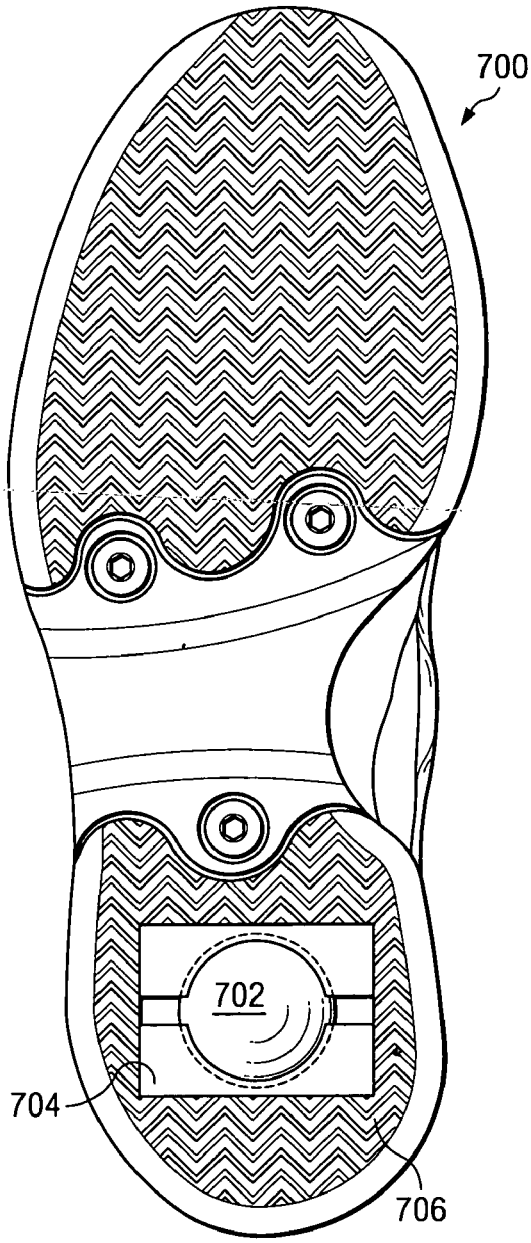
FIG. 13 is a bottom view that illustrates another embodiment of the present invention with a spherical ball serving as a wheel and positioned in a mounting structure in an opening in the heel portion of the sole.

In one embodiment of the present invention, the wheel assembly does not include an axle, and, arguably, not a mounting structure, and the wheel 16 is provided as a sphere, such as a stainless steel ball bearing, that is rotatably positioned in the opening in the bottom of the heel portion 18 of the sole 14, one embodiment of which is shown in FIG. 13. In another embodiment, the wheel assembly comprises an axle positioned completely through or partially through the heel portion 18 of the sole 14 such that the sole 14 supports the axle and the wheel is rotatably mounted on the axle in the opening of the sole 14. In this manner, the need for the mounting structure is eliminated.

Figure 12:
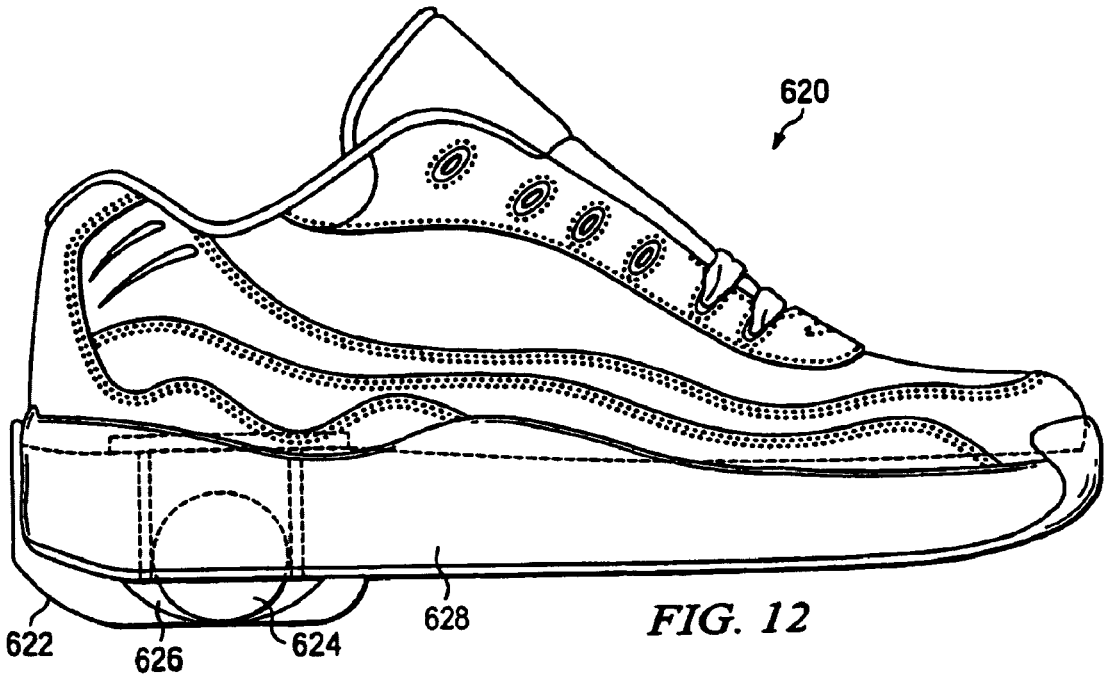
FIG. 12 is a side view of another embodiment that illustrates the heeling apparatus of the present invention with a removable wheel cover positioned to cover the wheel and the opening in the sole.

In operation, a person wearing the heeling apparatus 10 may either walk normally or roll on the wheel 16 by lifting or raising the sole 14 so that only or almost only the wheel 16 contacts a surface. This action may be referred to as "HEELING" or to "HEEL." The wheel 16, depending on the desired implementation of the present invention, may be removed or retracted to a position such that the wheel 16 does not extend below the bottom of the sole 14. This, generally, will result in the heeling apparatus 10 performing like an associated footwear. When the wheel 16 is removed or retracted, a removable cover may be placed over the opening in the bottom of the sole 14 to prevent debris from entering the opening and potentially damaging the wheel assembly. In still other embodiments, a removable cover may be placed over the wheel 16 while a portion of the wheel 16 remains extended below the bottom of the sole 14 to assist with walking, an example of this is illustrated in FIG. 12.

It should be understood, however, that even if the wheel 16 is not removed or retracted as just described, the user may still comfortably walk and run, even with the wheel 16 extended. This generally occurs because the distance 24 can be minimal, which provides a unique "stealth" or "covert" aspect to heeling. This also results in the wheel rolling the opening or hole in the sole 14 of the heeling apparatus 10. In one embodiment, the distance 24 is less than the radius of the wheel 16, which results in most of the wheel residing within the opening of the sole 14.

Figure 2A:
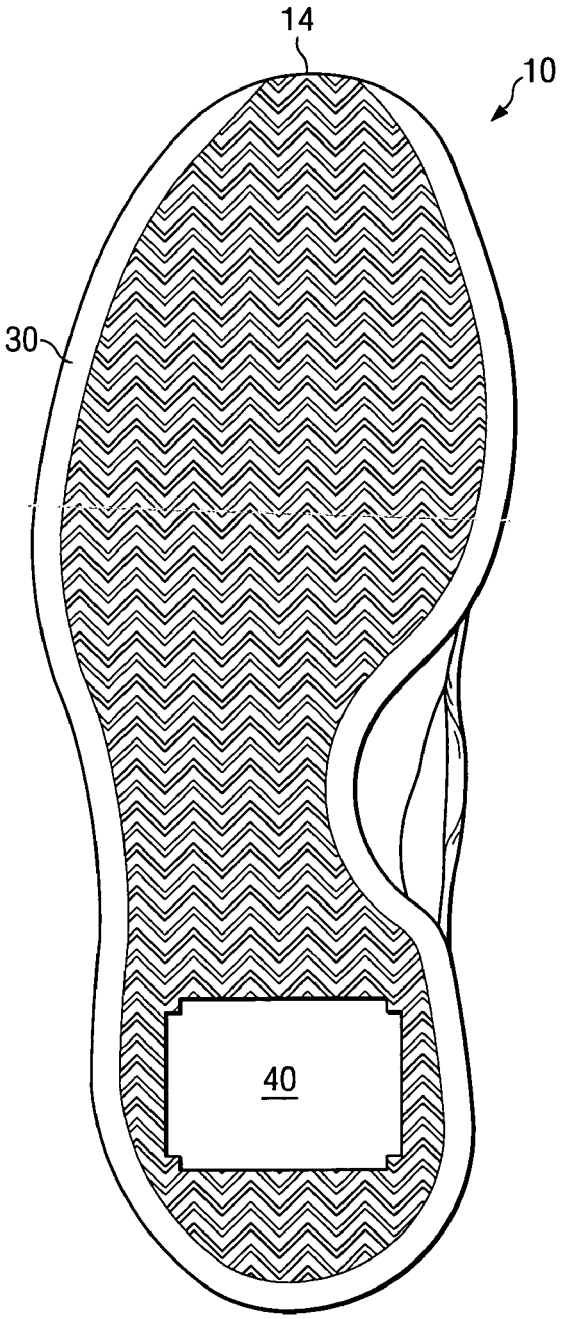
FIGS. 2A and 2B are bottom views that illustrate two embodiments of a sole of the heeling apparatus with openings in the sole.
Figure 2B:
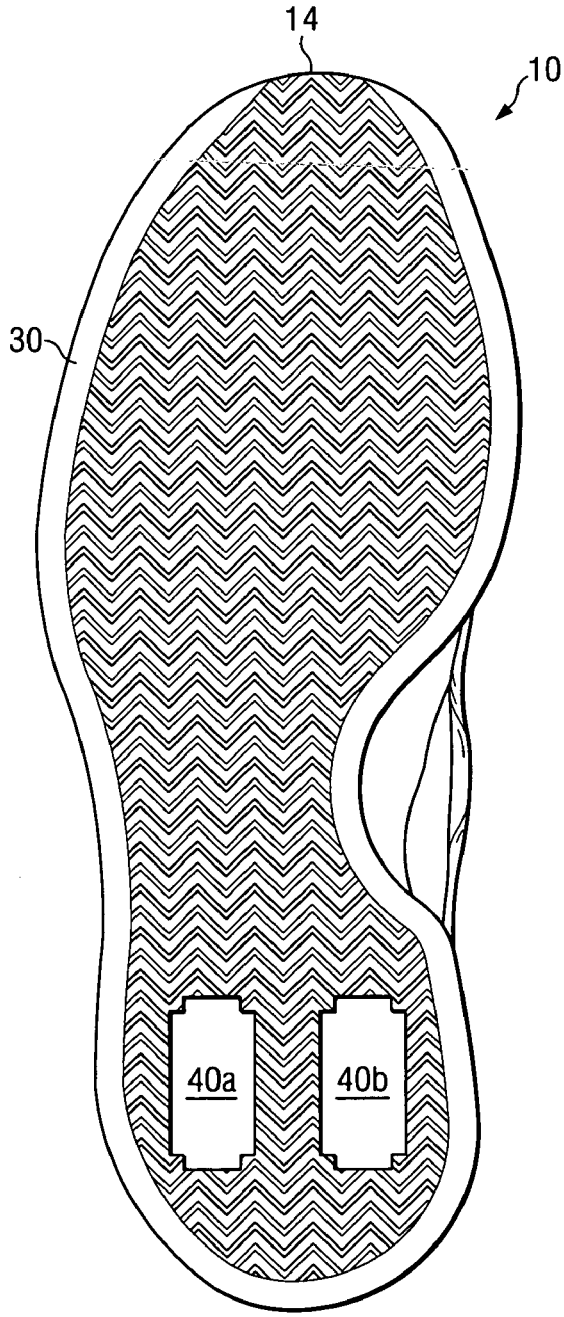

FIGS. 2A and 2B are bottom views of two embodiments of the sole 14 of the heeling apparatus 10. In particular, the outsole 30 or bottom of the sole 14 is illustrated in FIG. 2A with an opening 40 in the heel portion 18 of the sole 14. In the embodiment illustrated, the opening 40 is provided in a square or rectangular configuration. The opening 40, however, may be provided in virtually any configuration, such as, for example, a circular or an elliptical configuration.

As mentioned previously, the opening 40 may extend partially or completely through the sole 14. The opening 40 may be provided through a heel block or object. Further, the opening 40 be positioned in, near, or in a combination of the heel portion 18, the arch portion 20, and the forefoot portion 22.

FIG. 2B illustrates a second embodiment as to the placement and configuration of the opening 40. The outsole 30 is illustrated with an opening 40A and an opening 40B in the heel portion 18 of the sole 14. In this manner, one or more wheels, including one or more axles, may be positioned in both the opening 40A and 40B.

Figure 3A:
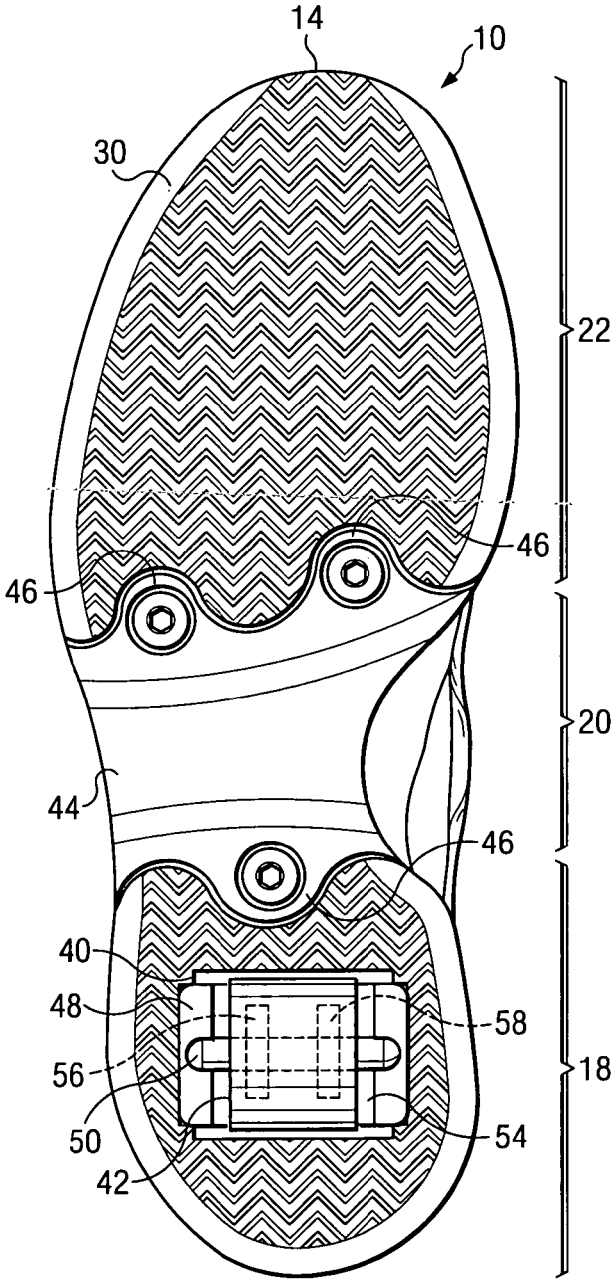
FIGS. 3A and 3B are bottom views of the two embodiments of the sole as shown in FIGS. 2A and 2B and illustrate a wheel in each of the openings of the soles.
Figure 3B:
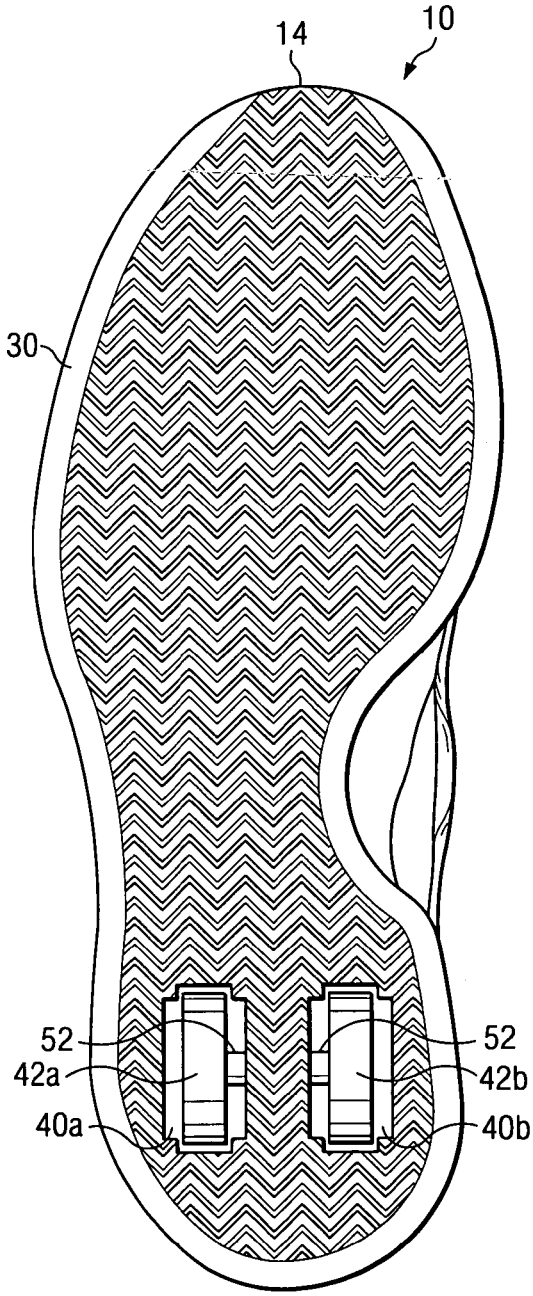

FIGS. 3A and 3B are bottom views of the two embodiments of the sole 14 as shown in FIGS. 2A and 2B and illustrate a wheel in each of the openings of the soles. This includes a wheel 42 positioned in the opening 40 in FIG. 3A and a wheel 42A and a wheel 42B in the openings 40A and 40B, respectively, of FIG. 3B.

The wheel 42 and the wheels 42A and 42B are illustrated as cylindrical wheels. These wheels, however, may be provided in virtually any available configuration. Further, one or more wheels may be positioned in each opening.

FIG. 3A further illustrates other elements of the wheel assembly that include a first member 48 and a second member 54 of a mounting structure that is used to removably couple with an axle 50. The axle 50 extends through the wheel 42 such that the wheel 42 is rotatably coupled or mounted to the axle 50. This preferably involves the use of precision bearings, such as high performance precision bearings, provided in a recess, such as an annular recess, on either side of the wheel 42. A first precision bearing 56 and a second precision bearing 58 may be ABEC grade precision bearings and are illustrated with hidden lines and positioned in the first recess and second recess of the wheel 42. In alternative embodiment, loose ball bearings may be used.

The axle 50 may be made of any material that provides suitable physical characteristics, such as strength and weight, to name a few. The axle 50 is preferably made of hardened steel, is cylindrical in shape, each end is rounded, and is removably coupled with a first member 48 and a second member 54, respectively, of the mounting structure. The removable coupling between each end of the axle 50 and the first member 48 and the second member 54 may be achieved by any known or available mechanism. In a preferred embodiment, a sphere or a ball bearing, preferably using a moveable spring and/or a screw bias, is used to contact and exert a side wall force between one or members of the mounting structure and the axle 50.

It should also be noted that because the weight of the user of the heeling apparatus 10 will exert a significant downward force and the ground or surface will exert an equal force upward, the axle 50, and, hence, the wheel 42 will generally be forced into place. Only when the heel is raised from a surface will any force or friction be required to keep the axle 50 in place. Thus, the present invention does not require a large side force to keep the axle 50 and the wheel 42 in place. The recognition of this fact may be considered an aspect of the present invention for the embodiment as shown. This recognition allows the removable coupling between each end of the axle 50 and the first member 48 and the second member 54 to be optimally designed.

FIG. 3A also illustrates a grind plate 44 (which also may be referred to as a slide plate 44) that may be used in conjunction with the heeling apparatus 10 of the present invention. The grind plate 44 provides a smooth or relatively smooth surface to allow a user to "grind" or "slide" on various surfaces such as hand rails, curbs, steps, corners, and the like. The grind plate 44 is preferably somewhat thin and made of a plastic or polymer material. In a preferred embodiment, the grind plate 44 is removably attached to the arch portion 20 of the outsole 30 of the sole 14. The grind plate 44 may be attached using any known or available fastener, such as, for example, a fastener 46 shown in various locations around the periphery of the grind plate 44.

FIG. 3B further illustrates an axle 52 in which the wheel 42A and the wheel 42B are coupled to either end in the opening 40A and the opening 40B, respectively. The axle 52 extends through both the wheels 42A and 42B and through a portion of sole 14, not visible in FIG. 3B. This serves to support the axle 52 and illustrates the situation where the sole 14 serves as the mounting structure of the wheel assembly. This reduces the overall number of parts. In an alternative embodiment, a metal or some other suitable material may be used within the heel portion 18 of the sole 14 where the axle 52 is positioned to provide additional support and stability. This is an example where the mounting structure is, in effect, integrated into the sole 14. As can be appreciated by one skilled in the art, the present invention may be implemented in any number of ways.

Figure 4:
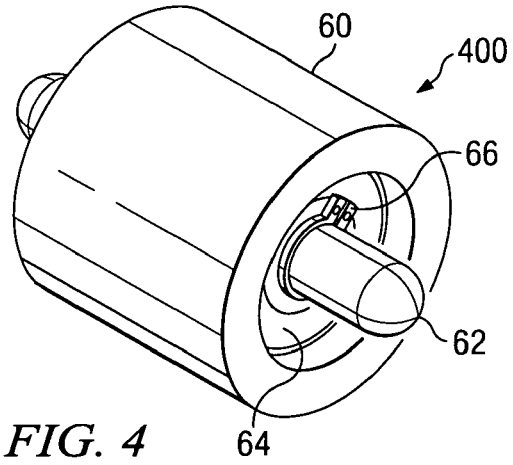
FIG. 4 is a perspective view that illustrates a wheel rotatably mounted to an axle, which also may be referred to as a wheel/axle assembly, for use in a wheel assembly according to one embodiment of the present invention.

FIG. 4 is a perspective view of a wheel 60 rotatably mounted on an axle 62, which also may be referred to as a wheel/axle assembly, for use in a wheel assembly, or in a heeling apparatus, according to one embodiment of the present invention. The wheel 60 and the axle 62 may also be referred to as a wheel/axle assembly 400. In this embodiment, the axle 62 extends through the wheel 60 and includes two ends that are rounded or bullet shaped. A precision bearing 64 is shown positioned in a recess, which is shown as an annular recess, of the wheel 60 to facilitate the rotation of the wheel 60 around the axle 62. Preferably a second precision bearing is positioned in a second recess, not shown in FIG. 4, to further facilitate such rotation.

A slip clip, slip ring, or ring clip 66 is shown positioned around, or nearly around, the axle 62 near the precision bearing 64. This serves to ensure that the precision bearing 64 remains in place in the recess of the wheel 60. The slip clip or ring clip 66 will preferably be positioned on the axle 62 through a groove, such as a radial groove or radial indentation, in the axle 62. It should be understood, however, that one of ordinary skill in the art may use any of a variety of other arrangements to ensure that the precision bearing 64 stays in position. In alternative embodiments, the precision bearing 64 may be eliminated or loose bearings may be used.

The wheel 60 rotatably mounted on the axle 62 may, in alternative embodiments, serve as the wheel assembly of the present invention. In such a case, the axle 62 may be mounted to the sole, such as the midsole and heel portion, at its ends while the wheel 60 is rotatably provided in the opening of the sole. In this manner, the need for a mounting structure may be thought of as eliminated or, alternatively, the mounting structure may be thought of as integrated into the sole of the footwear.

Figure 5:
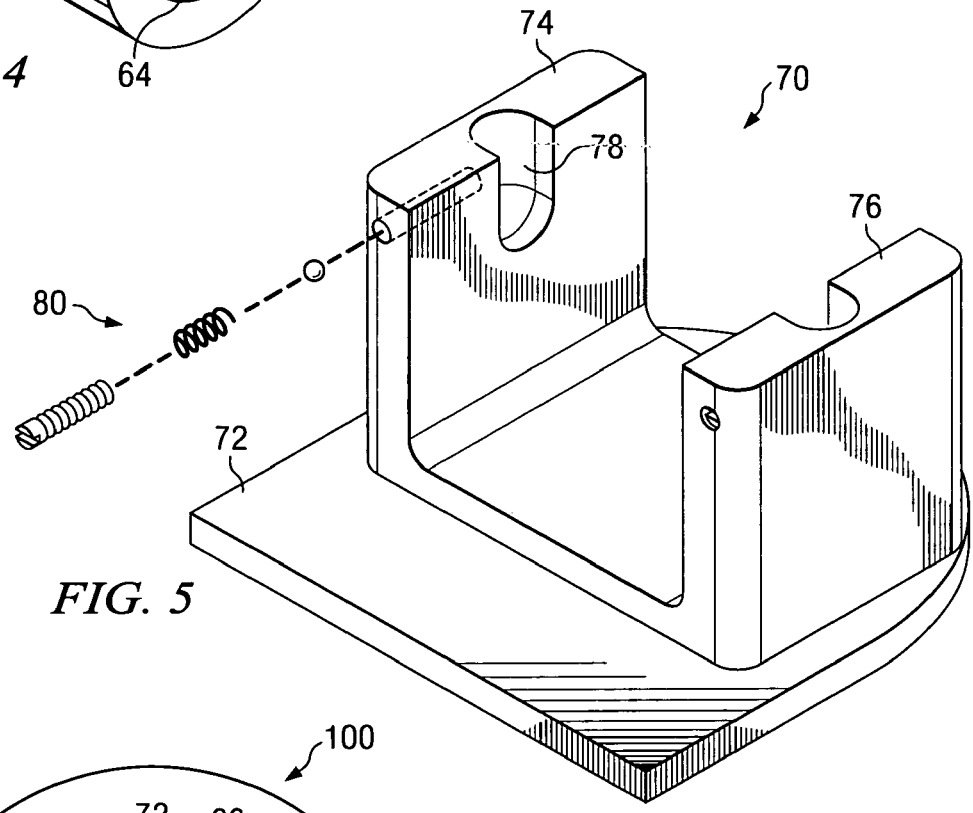
FIG. 5 is a perspective view that illustrates a mounting structure for use with a wheel rotatably mounted to an axle, as illustrated in FIG. 4, to form a wheel assembly.

FIG. 5 is a perspective view of a mounting structure 70 for use with a wheel rotatably mounted to an axle, such as is illustrated in FIG. 4, to form a wheel assembly. The mounting structure 70 generally includes a heel control plate 72, a first member 74, and a second member 76. In alternative embodiments, a spring, such as a leaf spring, could be provided where the two members contact the heel control plate 72. This would provide the added benefit of greater cushion and suspension. The two members include an opening, such as the opening 78 of the first member 74 to receive an end of an axle. It should be mentioned that the opening may be provided in virtually any configuration, including extending through the member, or placed at different positions, or even multiple positions for mounting the wheel/axle assembly 400 at a retractable position and an extended position, on the member.

The axle that is to be positioned in the openings of the first member 74 and the second member 76 will preferably be removably coupled. This may be achieved by any number of arrangements and configurations, all of which fall within the scope of the present invention. One such arrangement is the screw/spring/ball bearing arrangement 80 provided in first member 74. This arrangement provides an adjustable bias or force that can be exerted against the axle when it is inserted into the opening 78. The screw is accessible and adjustable by the user. The turning of the screw affects the compression of a spring which, in turn, provides a force on a ball bearing that extends out into the opening 78. When the axle is inserted into the opening 78, the ball bearing may be displaced an amount and the screw/spring/ball bearing arrangement 80 will provide a side force to allow the axle to be secure, yet removable. A similar arrangement may also be provided in the second member 76 to provide a friction fit or coupling on the other end of the axle 62.

Figure 6:
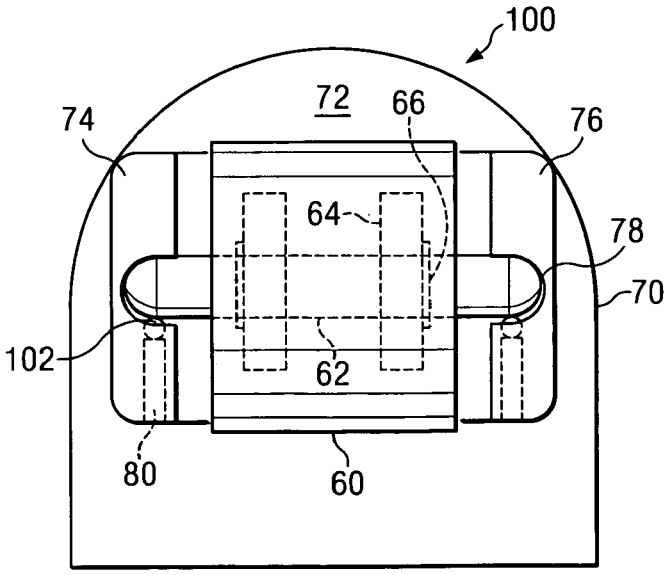
FIG. 6 is a bottom view that illustrates a wheel assembly that includes the wheel rotatably mounted on the axle as shown in FIG. 4 and the mounting structure of FIG. 5.

Although the screw/spring/ball bearing arrangement 80 of FIG. 5 is shown being implemented through a horizontal opening in the first member 74, it may be implemented in using an opening aligned in virtually any manner in the member. For example, the adjustment of the tension or pressure on the screw/spring/ball arrangement 80 may be achieved through a diagonal opening such that the exposed end of the screw/spring/ball arrangement 80, normally a screw head end, is provided where the reference line for numeral 74 in FIG. 5 contacts the first member 74. This provides easier access to adjust the tension and friction fit on the axle 62 when the wheel assembly, such as wheel assembly 100 of FIG. 6, is engaged or positioned within the opening of a sole to form a heeling apparatus. Of course, any of a variety of other arrangements, configurations, and opening alignments may be contemplated and implemented under the present invention.

The mounting structure 70 can be made or constructed of virtually any material, generally depending on the desired mechanical characteristics such as, for example, rigidity and strength. These materials may include, for example, a plastic, a polymer, a metal, an alloy, a wood, a rubber, a composite material, and the like. This may include aluminum, titanium, steel, and a resin. In one embodiment, the mounting structure 70 is made of a metal, such as aluminum, that has been anodized such that the mounting structure 70 presents a black color or hue.

FIG. 6 is a bottom view of a wheel assembly 100 that includes the wheel 60 rotatably mounted to the axle 62, as shown in FIG. 4, and the mounting structure 70 of FIG. 5. The first member 74 and the second member 76 each removably couple with the ends of the axle 62 through a bias mechanism implemented using a bias mechanism, such as the screw/spring/ball bearing arrangement 80. A ball bearing 102 is shown contacting one end of the axle 62 in the opening 78. Further slip clips or ring clips (which may also be referred to as snap rings or slip rings), such as ring clip 66, are provided to ensure that the precision bearings positioned in the recesses of the wheel remain in position.

The heel control plate 72 allows the user of the heeling apparatus to gain greater control and to obtain greater performance out of the heeling apparatus.

Figure 7:
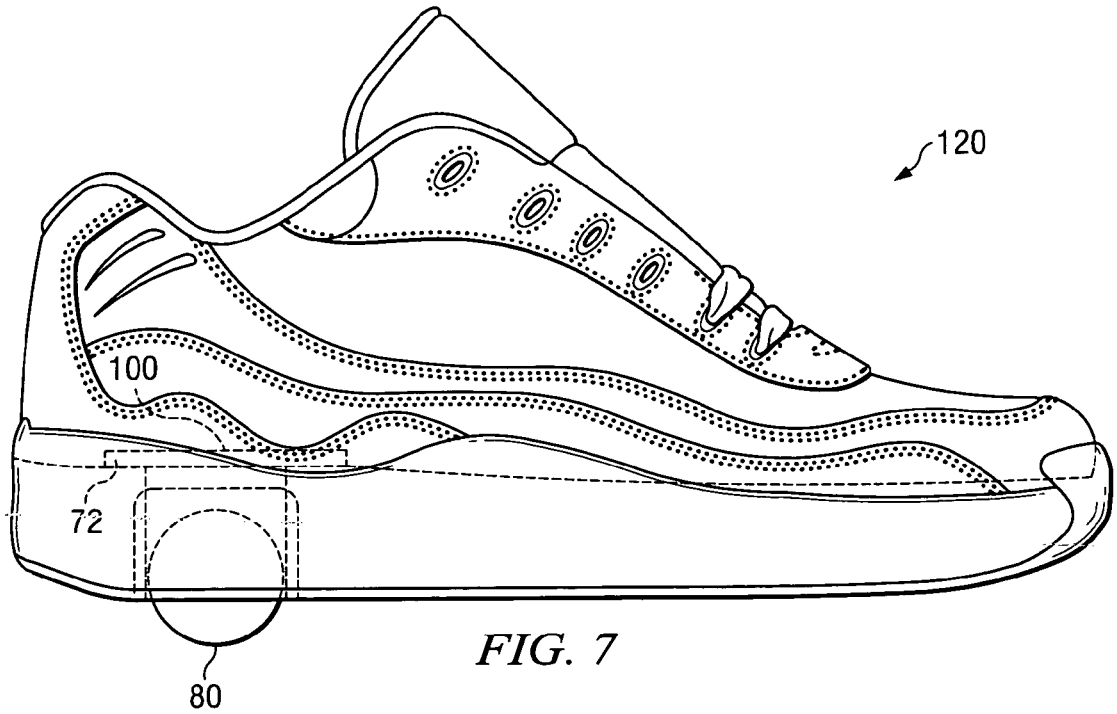
FIG. 7 is a side view that illustrates the wheel assembly positioned above and through the opening in a footwear to form a heeling apparatus.

FIG. 7 is a side view of the wheel assembly 100 positioned above and through the opening to form a heeling apparatus 120. The heel control plate 72 resides inside the shoe so that the heel of the user may apply pressure to the heel control plate as desired to provide better handling and performance of the heeling apparatus 120.

Figure 8A:
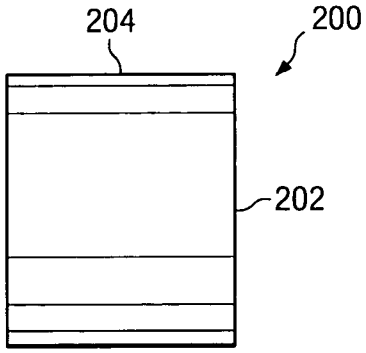
FIGS. 8A, 8E, 8C, and 8D are profile views of various wheels that illustrate the surface profile of these wheels that may be used in various embodiments of the present invention.
Figure 8B:
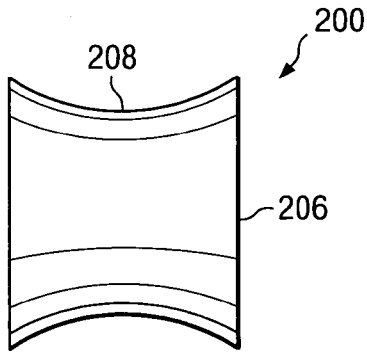
Figure 8C:
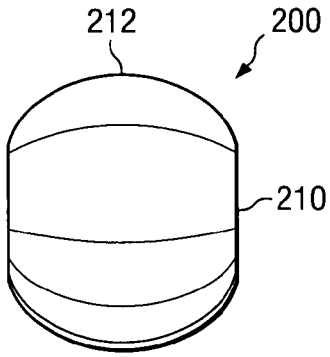
Figure 8D:
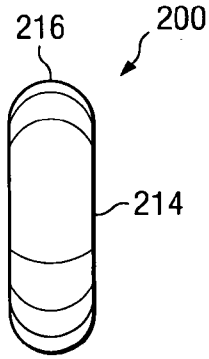

FIGS. 8A, 8B, 8C, and 8D are profile views of various wheels 200 that illustrates the surface profile of these wheels that may be used in various embodiments of the present invention. In FIG. 8A, a wheel 202 is shown with a flat or square surface or exterior profile 204. In FIG. 8B, a wheel 206 is shown with an inverted surface profile 208. In FIG. 8*c*, a wheel 210 is shown with round surface profile 212. Finally, in FIG. 8D, a wheel 214 is shown with a steep surface profile 216. The present invention may incorporate virtually any available surface profile of a wheel.

Figure 9:
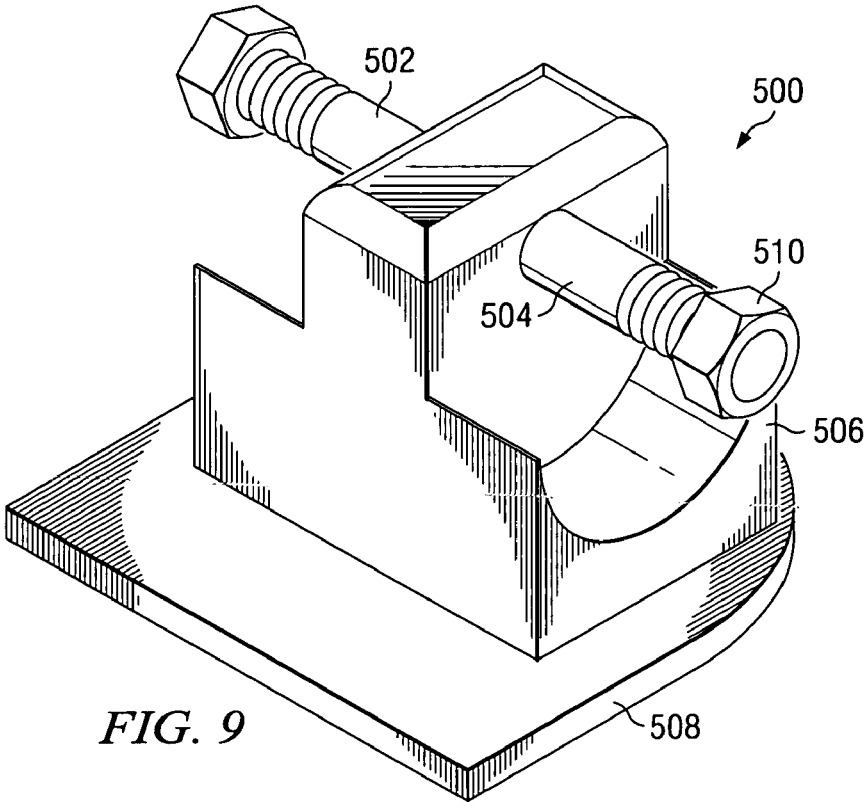
FIG. 9 is a perspective view that illustrates a mounting structure of another embodiment for use in a wheel assembly of a heeling apparatus.

FIG. 9 is a perspective view that illustrates a mounting structure 500 of another embodiment for use in a wheel assembly of a heeling apparatus. The mounting structure 500 includes an axle 502, which may be considered one axle that extends through and is mounted through a member 50 or as an axle 502 that couples with the member 506 along with an axle 504 that couples with the member 506 opposite axle 502. The mounting structure 500 also includes a heel control plate 508 coupled with the member 506.

The mounting structure 500 allows for two wheels to be mounted to form a wheel assembly. A wheel may be rotatably mounted on the axle 502, preferably using a precision bearing, and a wheel may be rotatably mounted on the axle 504, also preferably through a precision bearing as illustrated previously herein.

Figure 10:
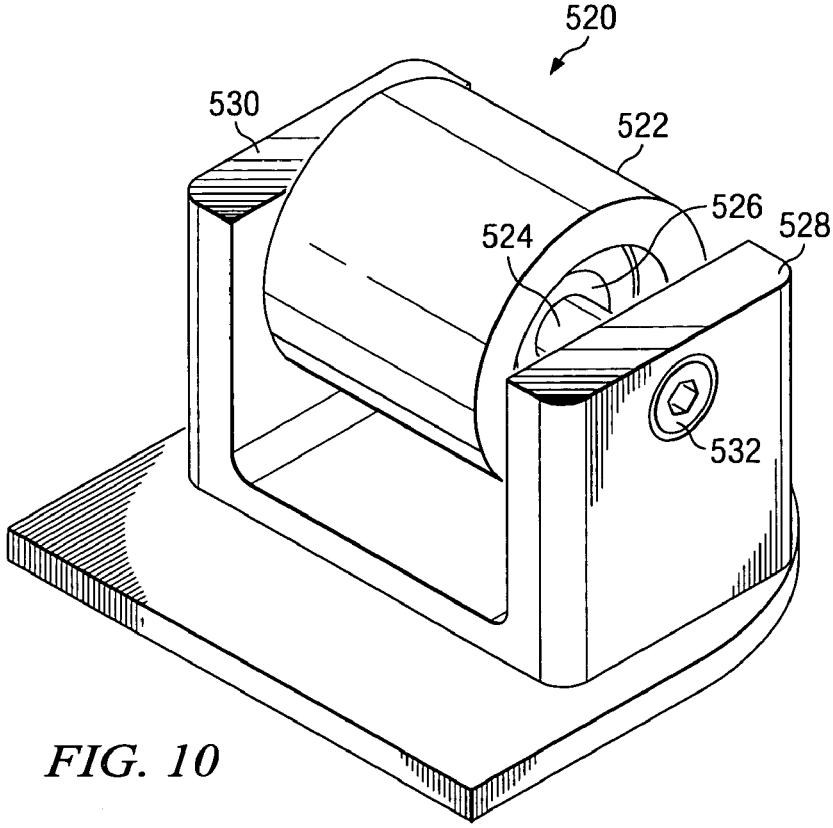
FIG. 10 is a perspective view that illustrates a wheel assembly that uses yet another embodiment for use in a heeling apparatus.

The axle 502 and the axle 504 include a threaded portion such that a nut, such as a lock nut 510 may be included to secure a wheel to each axle. In other embodiments, the end of the axles may include internal threads, as opposed to external threads as shown, so that a screw, such as the hex screw as shown in FIG. 10. It should be understood that virtually any available coupling may be provided between the axle and the member.

FIG. 10 is a perspective view that illustrates a wheel assembly 520 that uses yet another embodiment for use in a heeling apparatus and includes a wheel 522 rotatably mounted to an axle 524 using a precision bearing 526, and a first member 528 and a second member 530 coupled to each end of the axle 524 through a screw, such as hex screw 532. The wheel assembly 520 is similar to wheel assembly 100, which was described above in connection with FIG. 6, except that the wheel/axle assembly cannot be as easily inserted and removed.

Figure 11:
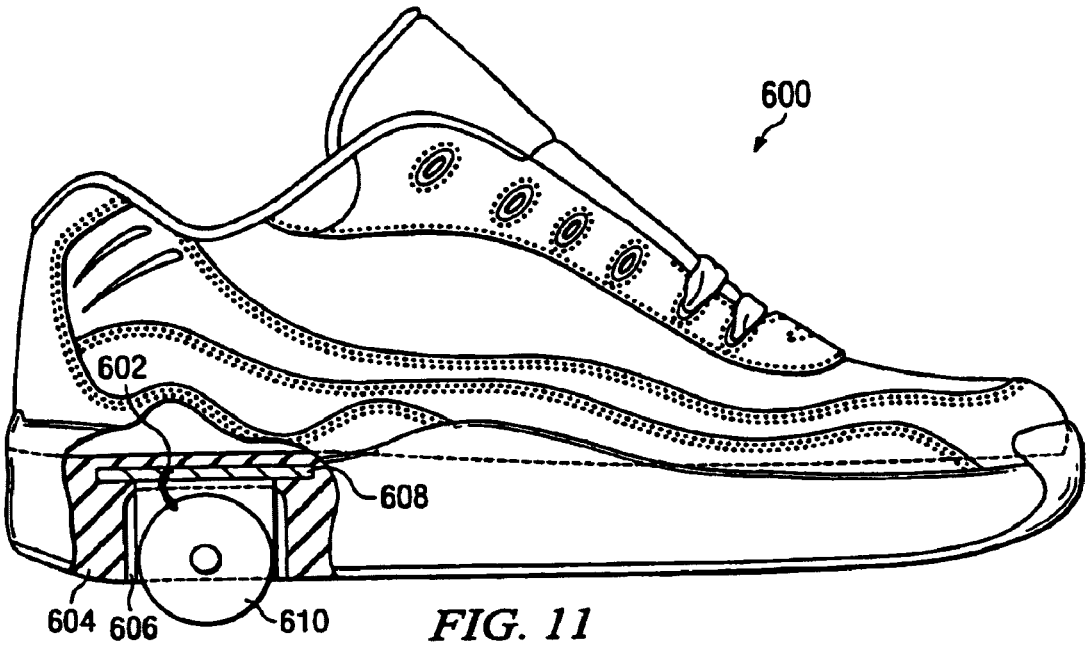
FIG. 11 is a side, partial cutaway view that illustrates one embodiment of a heeling apparatus that illustrates the wheel assembly provided in the sole of the heeling apparatus and the opening in the sole not extending completely through the sole.

FIG. 11 is a side, partial cutaway view that illustrates one embodiment of a heeling apparatus 600 that illustrates a wheel assembly 602 provided in a sole 604 and an opening 606 in the sole 604 that does not extend completely through the sole 604. As such, the mounting structure 608 may be provided or integrated into the sole 604 and may not be readily or easily removed. A wheel 610 is also shown extending partially below the bottom of the sole 604, which provides the advantage of stealth heeling.

FIG. 12 is a side view of another embodiment that illustrates a heeling apparatus 620 of the present invention with a removable wheel cover 622 positioned to cover a wheel 624 and an opening 626 in a sole 628. The removable wheel cover 622 allows for the wheel to be provided in an extended position, i.e., below the bottom surface of the sole 628, yet not engage a surface to roll. Although the heeling apparatus 620 of the present invention allows a user to walk and run, even with the wheel in an engaged position, the removable wheel cover 622 provides protection from dirt and debris and provides greater stability.

In an alternative embodiment, a wheel stop, not expressly shown in FIG. 12, may be provided, in lieu of or in conjunction with the removable wheel cover 622, to stop the rotation of the wheel 624. In one embodiment, the wheel stop is made of virtually any material, such as a sponge or flexible material, that can be wedged between the wheel 624 and the opening 626 to stop or prevent the rotation of the wheel 624 and to stay in place through friction.

In other embodiments of the wheel cover 622, a wheel cover is provided when the wheel 624 has been removed from the heeling apparatus 620. In a preferred embodiment, this wheel cover is generally flush with the remainder of the bottom of the sole 628, and, hence, provides the function of a regular shoe when desired and protects the opening. This wheel cover may couple in any available manner, but preferably will couple to the wheel assembly in the same or similar manner that the wheel/axle assembly couples to the mounting structure. The removable wheel cover could clip or attach to the wheel assembly in many different ways.

FIG. 13 is a bottom view that illustrates another embodiment of a heeling apparatus 700 with a spherical ball 702 serving as a wheel and positioned in a mounting structure 704 in an opening in the heel portion of the sole 706.

Figure 14:
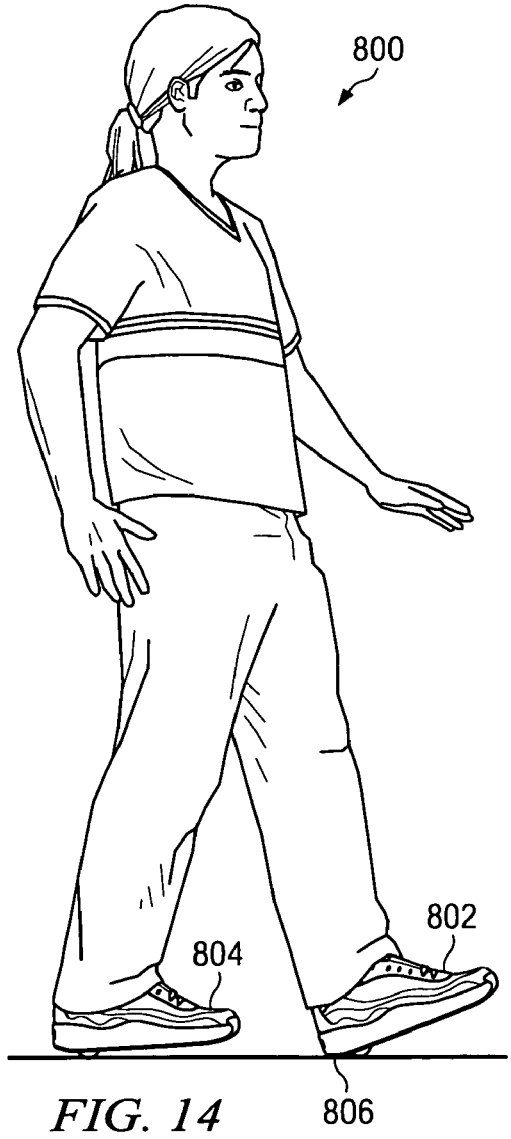
FIG. 14 is a perspective view that illustrates a "heeler" using the present invention to "heel"

FIG. 14 is a perspective view that illustrates a "heeler" 800 using the present invention to "heel." Heeling can be achieved using various techniques and, generally, requires a skill set of balance, positioning, flexibility, and coordination.

An illustrative method for using a heeling apparatus on a surface may include running on a surface by using a forefoot portion of a sole of the heeling apparatus to contact the surface, and then rolling on the surface with a wheel of the heeling apparatus extended below the bottom of the sole through an opening in the sole by using a wheel of the heeling apparatus to contact the surface. Before running on a surface, the method may include walking on the surface while wearing the heeling apparatus with a wheel of the heeling apparatus extended below the bottom of a sole portion of the heeling apparatus before running on the surface. Heeling may also be performed on a hill or a surface that includes a decline.

The method of heeling may also include engaging the wheel of the heeling apparatus to extend below the bottom of the sole portion of the heeling apparatus before walking on the surface. The method may also include walking on the surface while wearing the heeling apparatus before engaging the wheel of the heeling apparatus and with the wheel of the heeling apparatus retracted. Other variations on the method may include transitioning from rolling on the surface to either running, walking, or stopping on the surface by running on the surface through using the forefoot portion of the sole of the heeling apparatus to contact the surface just after rolling on the surface.

The preferred position while heeling is illustrated by the heeler 800 in FIG. 14 where one heeling apparatus 802 is placed in front of the other heeling apparatus 804 while rolling on a surface. As can be seen from a back heel portion 806 of the heeling apparatus 804, sometimes the clearance between the back heel portion 806 and the surface is small. As a result, in a preferred embodiment, the back heel portion 806 is made of a wear resistant material.

The method of heeling may also implement any number of techniques for slowing or stopping. For example, rolling may be slowed by contacting the forefoot portion of the sole of the heeling apparatus to contact the surface to create friction and to remove the wheel from the surface. Another example includes slowing by contacting a heel portion of the sole of the heeling apparatus to contact the surface.

Figure 15:
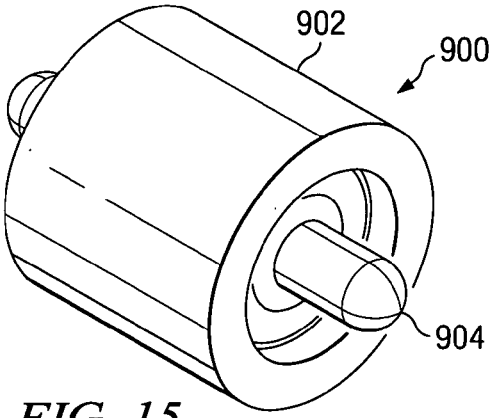
FIG. 15 is a perspective view that illustrates a wheel rotatably mounted to an axle, which also may be referred to as a wheel/axle assembly, similar to FIG. 4.
Figure 16:
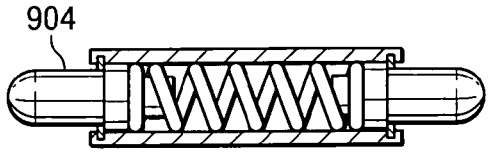
FIG. 16 is a cutaway view that illustrates a collapsible axle of the wheel/axle assembly of FIG. 15 implemented as a spring-loaded collapsible axle.

FIG. 15 is a perspective view that illustrates a wheel 902 rotatably mounted to a collapsible axle 904, which also may be referred to as a wheel/axle assembly 900, similar to FIG. 4. The collapsible axle 904 may be implemented in any number of ways, such as an adjustable axle that is spring loaded, similar to what is shown in FIG. 16, or as a screw collapsible axle. This allows the wheel/axle assembly 900 to be more easily removable and/or retractable to a position where the wheel would not engage the ground if the wheel/axle assembly 900 were implemented in a heeling apparatus.

FIG. 16 is a cutaway view that illustrates a collapsible axle 904 of the wheel/axle assembly 900 of FIG. 15 implemented as a spring loaded collapsible axle. As can be seen, the collapsible axle 904 may be adjusted or shortened by inwardly compressing both ends of the collapsible axle 904 to overcome the internal spring force.

Figure 17:
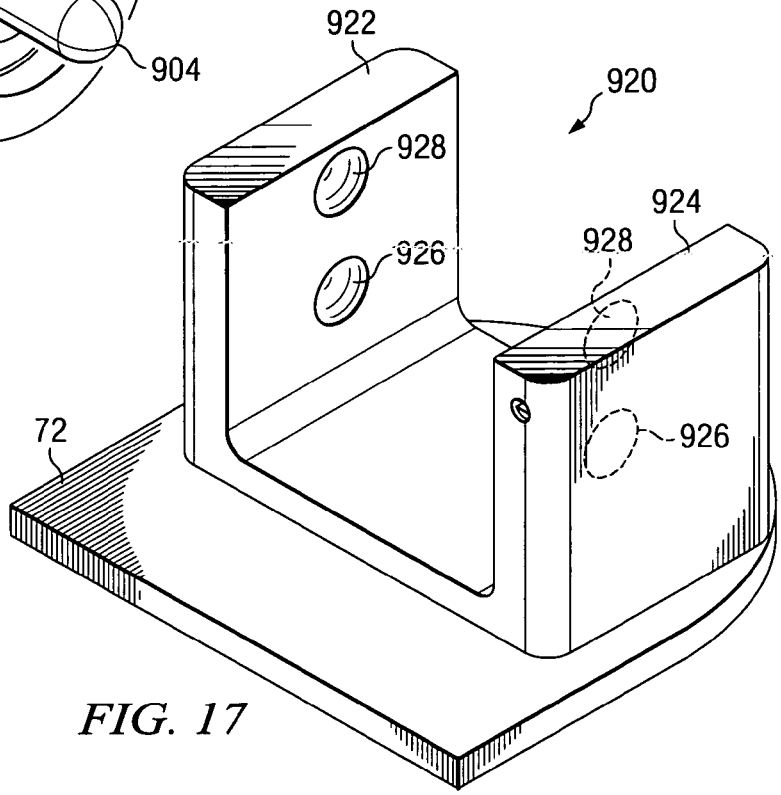
FIG. 17 is a perspective view that illustrates another mounting structure for use with the wheel/axle assembly and the collapsible axle, as illustrated in FIG. 15 and FIG. 16, to form a wheel assembly.

FIG. 17 is a perspective view that illustrates another mounting structure 920 for use with the wheel/axle assembly 900 and the collapsible axle 904, as illustrated in FIG. 15 and FIG. 16, respectively, to form a wheel assembly. The collapsible axle 904 may couple to a first member 922 and a second member 924 at a first position 926 at the first member 922 and the second member 924 so that the wheel is in a retracted position. The collapsible axle 904 may also couple to the first member 922 and the second member 924 at a second position 928 so that the wheel is in an extended position.

Figure 18:
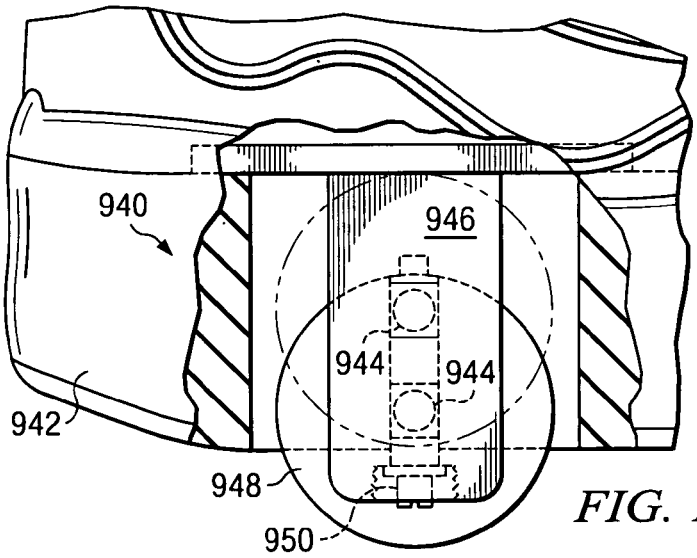
FIG. 18 is a side, cutaway view that illustrates a wheel assembly positioned through an opening in a sole that illustrates one embodiment of an axle that couples to the mounting structure to provide a retractable wheel using an assembly that may be referred to as a king pin arrangement.

FIG. 18 is a side, cutaway view that illustrates a wheel assembly 940 positioned through an opening in a sole 942 that illustrates one embodiment of an axle 944 that couples to a mounting structure 946 to provide a retractable wheel 948 using an assembly that may be referred to as a king pin arrangement or dual king pin arrangement. This allows the retractable wheel 948 to be adjusted up or down, as desired, and from a retractable position to an extended position. A king pin 950 (which may be implemented as a threaded screw or bolt) is shown threadingly engaged in a threaded opening in a member of the mounting structure 946. As the king pin 950 is screwed further into the opening in the member, the axle 944 is further retracted. A king pin 950 will also be provided at the other member to raise the other side of the axle 944. In other embodiments, such as the mounting structure 500 in FIG. 9, a single king pin could be provided through the single member to provide retractable wheels through the coupling of the members and the axle.

An example of a king pin type assembly is illustrated in U.S. Pat. No. 4,295,655, which is incorporated herein by reference for all purposes, issued to David L. Landay, et al., was filed on Jul. 18, 1979, was issued Oct. 20, 1981. This patent illustrates a king pin type assembly that could be implemented in an embodiment of the present invention.

FIG. 19 is a bottom view that illustrates the wheel assembly 940 of FIG. 18 and further illustrates the dual king pin arrangement and the king pins 950 through the members of the mounting structure 946.

FIG. 20 is a side view that illustrates one member of the mounting structure 946 and further illustrates the coupling of the axle 944 to the mounting structure 946 using the dual king pin arrangement similar to FIG. 18. As discussed above, this allows the axle 944, and hence the attached wheel, to be transitioned to any of a desired levels, and from a retracted position to an extended position.

It should be understood that the axle may couple to a member of a mounting structure using any available technique and in virtually an unlimited number of ways. For example, an axle may couple to the first member and the second member of a mounting structure to move from a retracted position to an extended position through a spring arrangement. Similarly, an axle may couple to the first member and the second member of a mounting structure to move from a retracted position to an extended position through a hinged arrangement.

Many other examples are possible, for example U.S. Pat. No. 3,983,643, which is incorporated herein by reference for all purposes, issued to Walter Schreyer, et al., was filed on May 23, 1975, was issued Oct. 5, 1976 illustrates a retractable mechanism that may be implemented in one embodiment of the present invention. U.S. Pat. No. 5,785,327, which is incorporated herein by reference for all purposes, issued to Raymond J. Gallant, was filed on Jun. 20, 1997, issued on Jul. 28, 1998 illustrates simultaneously retractable wheels.

FIG. 21 is a breakaway and perspective view that illustrates a two piece wheel 970 that includes an inner core 972, an outer tire 974, such as a urethane wheel, an axle 976 (which may not be shown to skill), and a bearing 978 that may be used in the present invention. In a preferred embodiment, the bearing 978 is small in comparison to the two piece wheel 970, for example, the bearing 978 may have an outer diameter that is less than half the outer diameter of the outer tire 974. This can provide significant advantages, that include a softer ride, better control, and are longer lasting. This is because the outer tire 974 can be larger and thicker. In other embodiments, the bearing 978 is larger and has an outer diameter that is more than half the outer diameter of the outer tire 974. In a preferred embodiment, the inner core portion of the two piece wheel is made of a harder material that provides rigidity for enhanced bearing support, while the outer tire portion is made of a softer material, such as a soft urethane, for improved performance and a quieter ride. These types of wheels may be referred to as a "dual durometer" type wheel.

Figure 22:
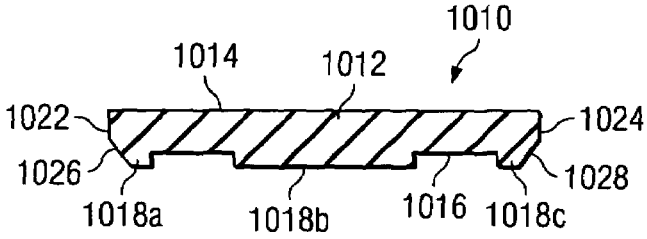
FIG. 22 is a side view of one aspect of a grind rail apparatus constructed in accordance with the present invention.

FIG. 22 illustrates a side view of a grind rail apparatus 1010 that is coupable to the underside of a footwear (not shown) for grinding. The grind rail apparatus 1010 includes a body 1012 having an upper side 1014 and a lower side 1016. A plurality of rails 1018 extend from the lower side 1016 of the body 1012. It will be appreciated that the rails 1018 will engage the grinding surface (not shown) and provide an optimum grinding area by providing less friction while grinding. In addition, the reduced grinding surface area provides additional sensitivity to the user of the grind rail apparatus 1010, which provides for additional controllability while using the present invention for grinding.

In the present aspect, the upper side 1014 of the body 1012 is shown as a substantially flat surface, which provides for the body 1012 having a greater mass. This is advantageous since grinding causes a considerable shock on the grind rail apparatus 1010 and a fragile structure is inappropriate for such rugged use. Furthermore, such robust configuration of the grind rail apparatus 1010 allows for improved grinding or sliding since the configuration is substantially rigid.

Figure 23:
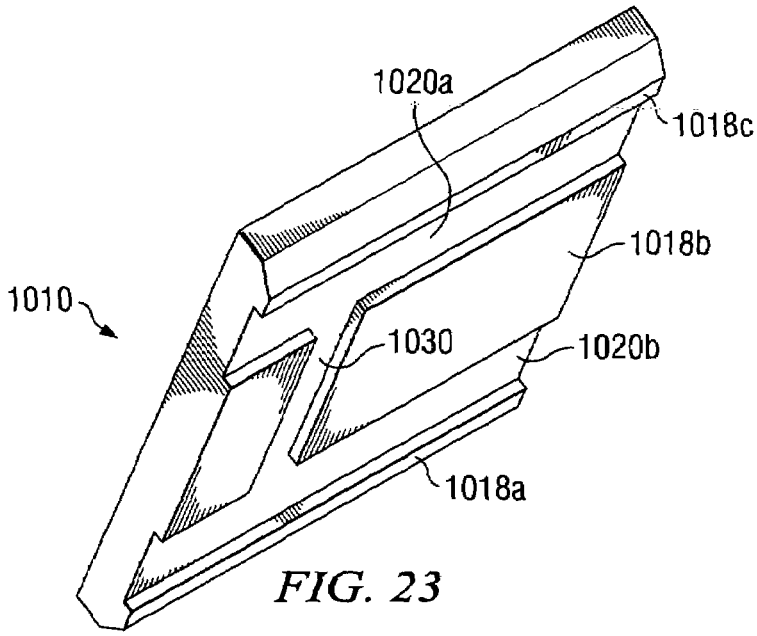
FIG. 23 is a perspective view of the grind rail apparatus illustrated in FIG. 22.

Referring also to FIG. 23, a perspective view of the grind rail apparatus 1010, as shown in FIG. 1, above is illustrated. In this aspect the grind rail apparatus 1010 is provided with channels 1020 disposed between the plurality of rails 1018. The rails 1018 and channels 1020 extend longitudinally along the lower side 1016 of the body 1012. It can be seen that the channels 1020 reduce the surface area of the grind rail apparatus 1010 that will contact the grinding surface during use. The body 1012 is further provided with a first side 1022 and a second side 1024 extending from the upper side 1014 to the lower side 1016 of the body 1012.

Although the first and second sides 1022 and 1024 may be substantially perpendicular with respect to the upper side 1014 of the body 1012, in this aspect the first and second sides 1022 and 1024 include an angled surface 1026 and 1028, respectively, extending toward the lower side 1016 of the body 1012. One benefit of the angled surfaces 1026 and 1028 is that individuals grinding typically engage the side of the footwear in a direction toward the grinding surface and thus, the angled surfaces 1026 and 1028 will initially contact the grinding surface and smooth the transition to the rails 1018 of the grind rail apparatus 1010. This transition will be discussed in greater detail hereinafter with respect to FIGS. 4 and 5 below.

In one aspect the grind rail apparatus 1010 may also be provided with lateral grooves 1030 extending across the lower side 1016 of the body 1012, which, according to one aspect, is defined by a portion of the grind rail 1018*b*. Although only one lateral groove is shown, it will be appreciated that in other aspects of plurality a lateral grooves 1030 may be provided across one or more of the rails 1018. The purpose of the lateral grooves 1030 is to promote and provide additional control while grinding. Furthermore, it should be understood that any number of rails and rails of different width and extending to various heights from the lower side 1016 of the body 1012 are within the scope of the present invention.

Figure 24:
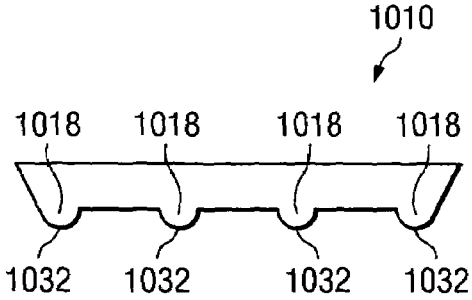
FIG. 24 is a side view of another aspect of the grind rail apparatus of the present invention.

FIG. 24 illustrates another aspect of the present invention of the rails 1018 of the grind rail apparatus 1010. In some aspects the lower side of the rails 1032 may be substantially flat, while in other aspects, such as in the present illustration, the lower side 1032 of the rails 1018 may be rounded. Furthermore, a number of configurations such as triangular or pointed rails having a defined edge may also be utilized and are within the spirit and scope of the present invention. In the present aspect, it can be seen that, while grinding, only the lower side 1032 of the rails 1018 will engage the grinding surface and provide minimal friction for smooth grinding and maximum sensitivity and control while grinding.

Figure 25:
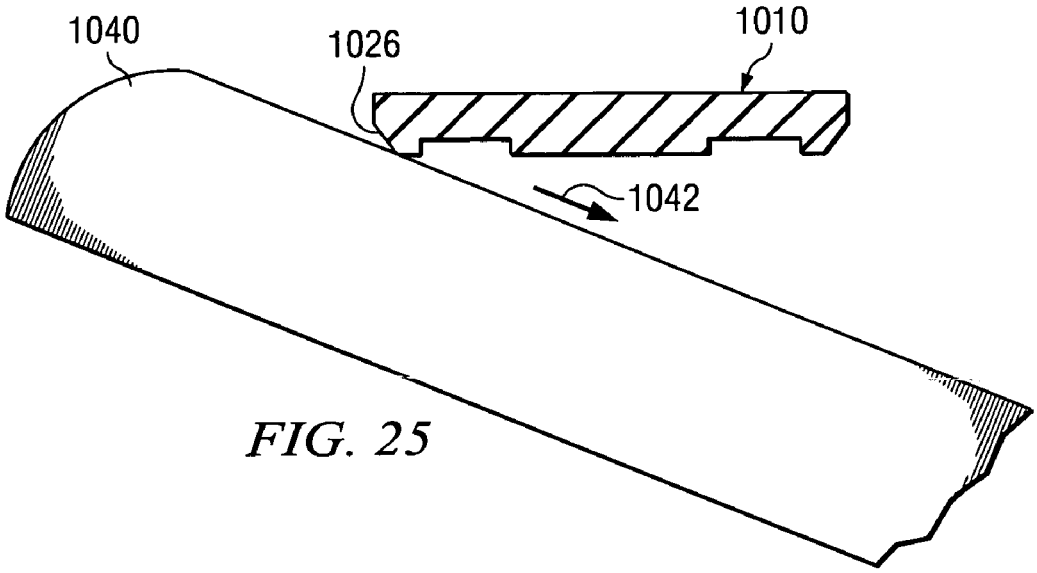
FIG. 25 is side view of the grind rail apparatus, illustrated in FIG. 22, shown grinding with a rail of the grind rail apparatus grinding on a pole.

FIG. 25 illustrates a pole 1040, such as a handrail, which is frequently used as a grinding surface. The grind rail apparatus 1010 is shown at an angle at which the user of the grind rail apparatus 1010 will ordinarily engage the grinding surface 1044. The angled surface 1026 of the grind rail apparatus 1010 provides a smoother initial engagement at this angle to allow the user to initially mount the pole 1040 to begin grinding. The user may then travel or grind a distance, which may be minimal, in a direction 1042 down the pole 1040.

Figure 26:
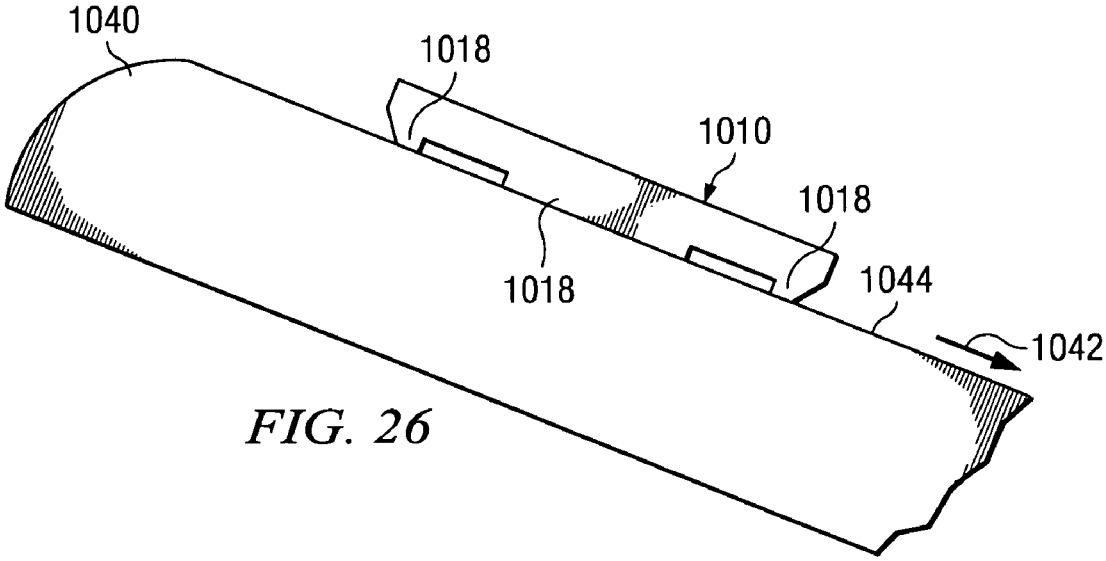
FIG. 26 is a side view illustrating the grind rail apparatus with the plurality of rails grinding on the pole shown in FIG. 25.

FIG. 26 illustrates the next step in the process of grinding wherein the individual utilizing the grind rail apparatus 1010 may then transition from an angled disposition, illustrated in FIG. 4, to a full grinding disposition, illustrated in FIG. 5, wherein the plurality of rails 1018 engage the grinding surface 1044. The individual utilizing the grind rail apparatus 1010 will continue to grind a distance in the direction 1042.

From time to time the individual utilizing the grind rail apparatus 1010 may initially mount the grinding surface 1044 wherein all of the rails 1018 initially contact the grinding surface 1044. As will generally be the case, however, the individual utilizing the grind rail apparatus 1010 will initially contact the grinding surface 1044 at some angle wherein the angled surface 1026 will be useful in assisting the user to transition to a full grinding position wherein all the rails 1018 engage the grinding surface 1044.

Figure 27:
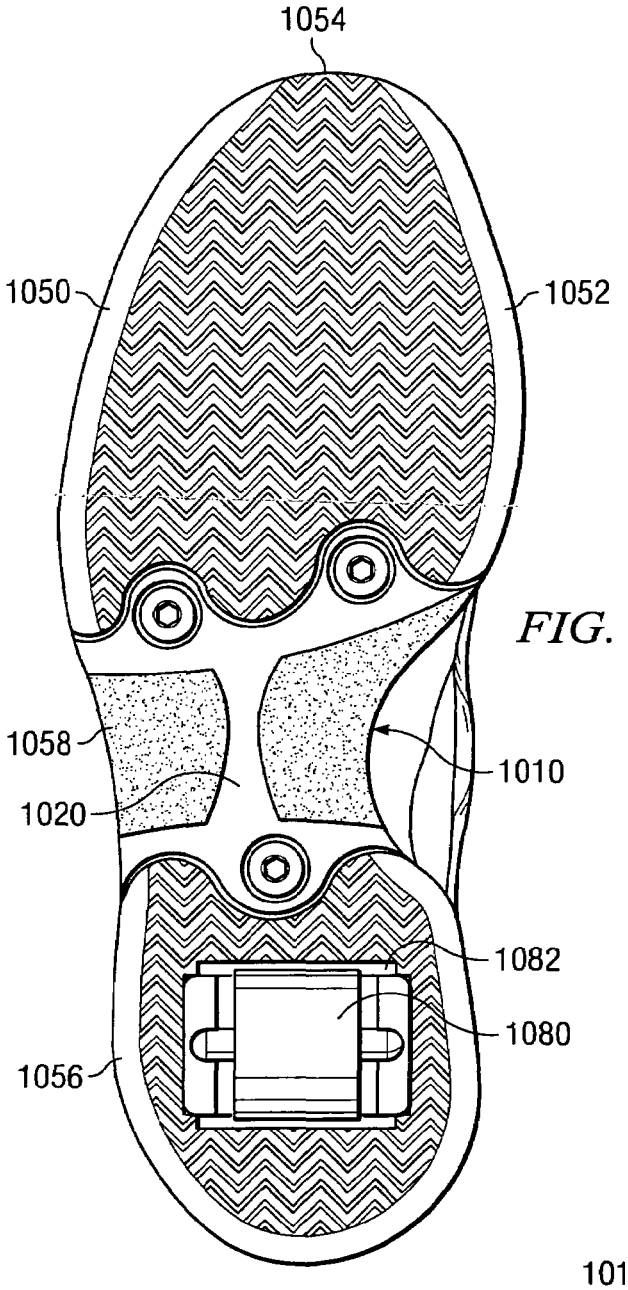
FIG. 27 is a view of a footwear provided in accordance with yet another aspect of the grind rail apparatus of the present invention.
Figure 28:
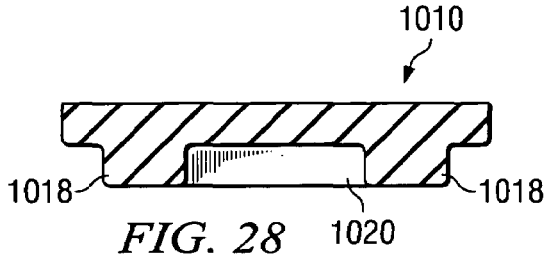
FIG. 28 is a side view of the grind rail apparatus illustrated in FIG. 6.

FIG. 27 illustrates the underside of a footwear 1050 employing another aspect of the grind rail apparatus 1010 constructed in accordance with the present invention. Referring also to FIG. 28, in the present aspect the grind rail apparatus 1010 includes a large channel 1020 between the rails 1018. This aspect illustrates the grind rail apparatus 1010 coupled to the footwear 1050 such that the grind rail apparatus 1010 appears to be two independent rails 1018 disposed on the underside of the footwear 1050, when, in fact, a portion of the sole is formed to cover a portion of the channel 1020 to the grind rail apparatus 1010. One advantage to such configuration is that this adds to the coupling and support of the grind rail apparatus 1010 to the underside of the footwear 1050.

In one aspect of the present invention, the upper side 1014 of the grind rail apparatus 1010 is substantially flat, while in other aspects the upper side 1014 is convex, or yet in other aspects, is concave on the upper side 1014 of the body 1012. A primary consideration being that the grind rail apparatus 1010 is coupled to the underside of the footwear 1050 in a secure manner.

In one aspect, the footwear 1050 may be provided with a forefoot 1054 portion of the sole and a heel 1056 portion of the sole wherein a recess (not shown) in the arch portion 1058 of the footwear is substantially flat. The flat configuration of the recess area of the arch portion 1058 is adapted to receive the flat upper side 1014 of the body 1012 of the grind rail apparatus 1010.

In this manner, the grind rail apparatus 1010 may be coupled to the footwear 1050 in a number of manners well known in the art, such as but not limited to, by a screw or threaded coupling, bonding by glue or other bonding materials, and a variety of other manners which will readily suggest themselves to one of ordinary skill in the art. However, a rigid and robust coupling of the grind rail apparatus 1010 to the footwear 1050 is important since the grind rail apparatus 1010 will be subject to a considerable amount of shock which would otherwise cause the grind rail apparatus 1010 to become disconnected or dislodged from its engagement with the footwear 1050. Thus, the addition of portions of the sole 1052 into the channel 1020 promotes additional engagement and coupling of the grind rail apparatus 1010 to the underside of the footwear 1050.

In one aspect, the present invention is directed to an apparatus for wearing on the foot of an individual that includes the grind rail apparatus 1010 and at least a first wheel 1080 which may be disposed in an opening 1082 in the heel portion 1056 of the footwear 1050. It should be appreciated that the apparatus may include one or more wheels in the forefoot 1054 as well. In this aspect, the wheel 1080 may be at least partially disposed within the opening 1082 and useful for rolling.

Figure 29:
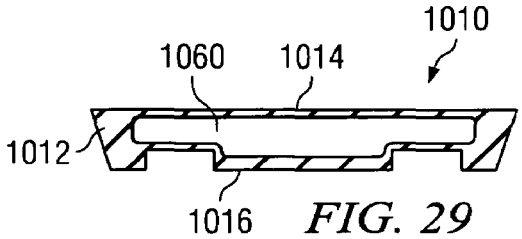
FIG. 29 is a side view of another aspect of the present invention provided with an inner chamber for absorbing shock.

FIG. 29 illustrates another aspect of the grind rail apparatus 1010 wherein an inner chamber 1060 is provided within the body 1012. In this aspect, the inner chamber 1060 may be filled with a resilient shock absorbing material, such as polymers or urethane solid of low density, or other resilient shock absorbing materials well known in the art. At least some of the shock of the initial impact of the rails 1018 engaging the grinding surface 1044 will be absorbed by the material disposed in the inner chamber 1060 and will not be communicated to the footwear 1050 and the user of the grind rail apparatus 1010. This is another advantage of the present invention since grinding necessarily requires a significant amount of contact and impact on various surfaces for grinding.

Figure 30:
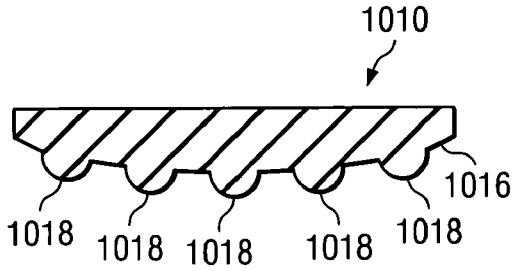
FIG. 30 is a cross-section of another aspect of the grind rail apparatus of the present invention.

FIG. 30 illustrates a cross-section of another aspect of the grind rail apparatus 1010. In this aspect, the lower side 1016 of the body 1012 is provided with the plurality of rails 1018 having a substantially rounded configuration. The rounded configuration of the rails 1018 may be advantageous to minimized the frictional contact between the grinding surface and the rails 1018. Furthermore, according to this aspect, the rails 1018 extend varying distances from the lower side 1016 of the body 1012 and are provided having diameters of varying sizes, which may be advantageous for transitioning from grinding on the different rails 1018.

Although this aspect illustrates rails 1018 having a rounded configuration, rails 1018 having a flat grinding surface, or in other aspects, rails 1018 of different geometric configuration are within the spirit an scope of the present invention.

Figure 31:
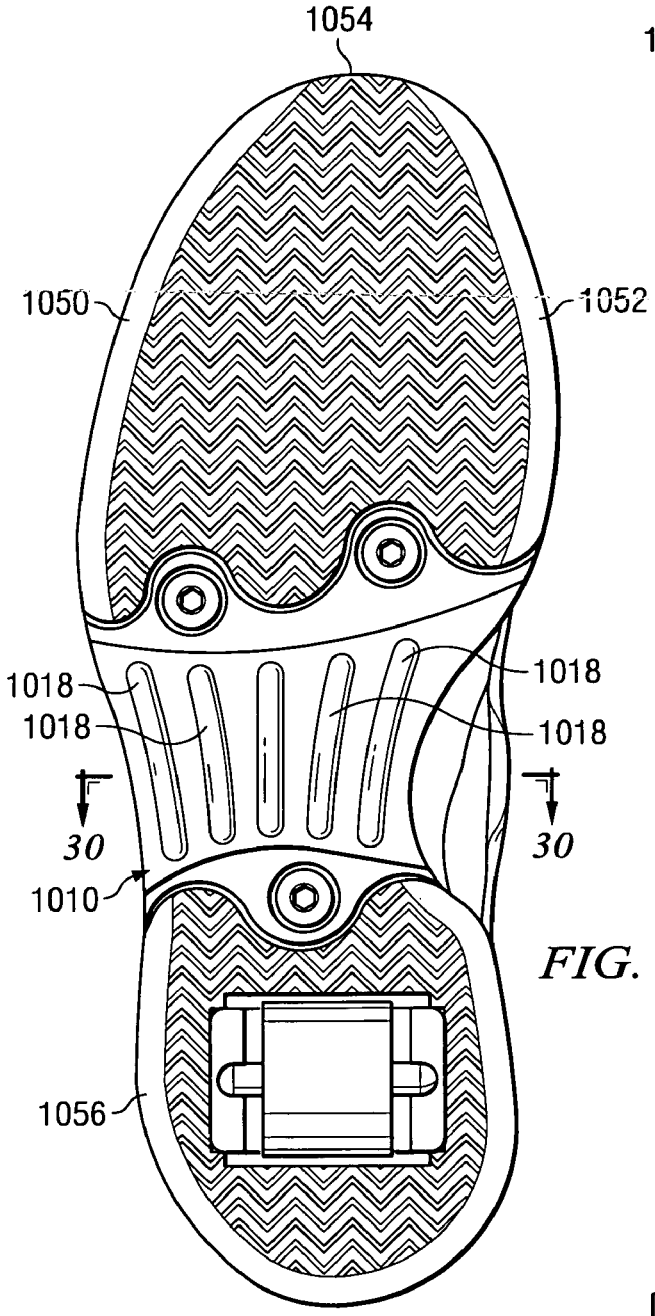
FIG. 31 is a bottom view of the footwear provided with the grind rail apparatus illustrated in FIG. 30.

FIG. 31 illustrates another aspect of the footwear 1050 provided with the grind rail apparatus 1010 illustrated in FIG. 30. In this view, it can be seen that the plurality of rails 1018 extend about the lower side 1016 of the body 1012. The plurality of rails 1018 extend from adjacent the heel portion 1056 to adjacent a forefoot portion 1054 of the sole 1052 of the footwear 1050. It is within the spirit and scope of the present invention that the overall lateral extension, disposition, location and configuration of the plurality of rails 1018 on lower side 1016 of the body 1012 may vary considerably, which is another advantage of the present invention. Specifically, the rails 1018, based on the configuration and location of the rails 1018, allows for unique and appealing designs on the lower side 1016 of the body 1012, while providing useful rails 1018 for grinding.

Figure 32:
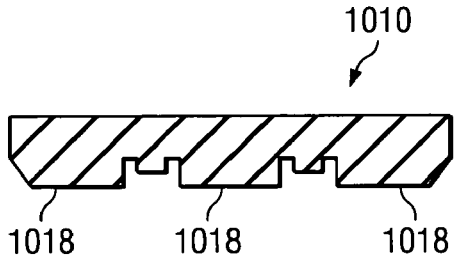
FIG. 32 is a cross-section of the grind rail apparatus, according to another aspect of the present invention.
Figure 33:
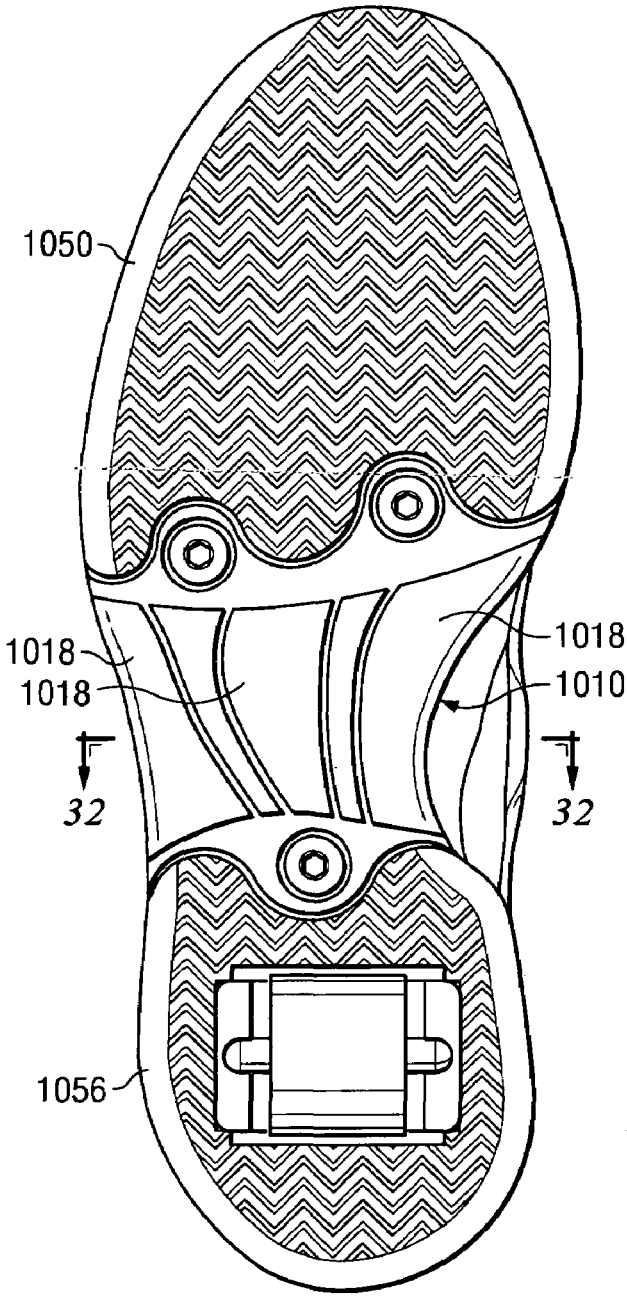
FIG. 33 is a bottom view of the footwear provided with the grind rail apparatus illustrated in FIG. 32.

FIG. 32 illustrates a cross-section of another aspect of the grind rail apparatus 1010, wherein the plurality of rails 1018 have a flat grinding surface and a greater overall width about the lower side 1016 of the body 1012. Referring also to FIG. 33, the footwear 1050 is provided with the grind rail apparatus 1010 illustrated in FIG. 32. As previously discussed, the plurality of rails 1018 may be disposed on the lower side 1016 of the body 1012 in a number of manners, which allows for construction of the grind rail apparatus 1010 having a unique visual design, such as illustrated, while maintaining the useful functional aspects for grinding.

Figure 34:
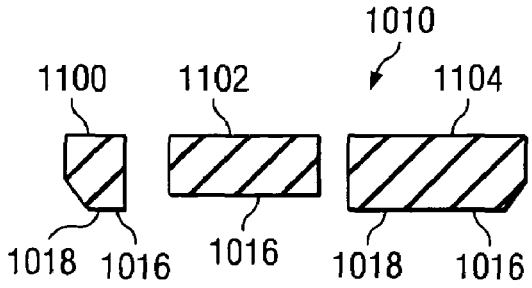
FIG. 34 is the grind rail apparatus, according to yet another aspect of the present invention.

FIG. 34 illustrates another aspect of the grind rail apparatus 1010 of the present invention. In this aspect, the present invention includes a first member 1100, a second member 1102 and a third member 1104 comprising the body 1012. Although three members 1100, 1102 and 1104 are illustrated in the present aspect, it will be appreciated that the body 1012 may be constructed using any number of members. It can be seen that the lower side 1016 of the first and third members 1100 and 1104 extends further than the lower side 1016 of the second member 1102. When the first, second and third members 1100, 1102 and 1104 are coupled to the sole 1052 of the footwear 1050, the grind rails 1018, are in effect, the lower sides 1016 of the first and third members 1100 and 1104.

For a more complete understanding of the present invention, incorporated herein by reference are U.S. Pat. No. 5,970,631 to Inman, U.S. Pat. No. 6,006,451 to Morris et al., U.S. Pat. No. 6,115,946 to Morris et al., U.S. Pat. No. 6,151,806 to Morris et al., U.S. Pat. No. 6,158,150 to Morris et al.

Thus, it is apparent that there has been provided, in accordance with the present invention, a grind rail apparatus that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various elements or components may be combined or integrated in another system or certain features may not be implemented.

Also, the components, techniques, systems, sub-systems, layers, compositions and methods described and illustrated in the preferred embodiment as discrete or separate may be combined or integrated with other components, systems, modules, techniques, or methods without departing from the scope of the present invention. Other examples of changes, substitutions, and alterations are readily ascertainable by one skilled in the art and could be made without departing from the spirit and scope of the present invention.

What is claimed is:

1. A grind rail apparatus for use on a footwear for grinding, the grind rail apparatus comprising:

a body having a substantially flat upper side, a lower side, a front, a back, a first lateral side disposed in a substantially perpendicular relationship with the upper side, a second lateral side disposed in a substantially perpendicular relationship with the substantially flat upper side, the upper side of the body configured for coupling to an underside of the footwear adjacent an arch portion of the footwear and the lower side of the body substantially arcuate between the front and the back of the body, and wherein the body is further provided with a first angled portion and a second angled portion, the first angled portion angularly extending from the first lateral side to the lower side of the body and the second angled portion angularly extending from the second lateral side to the lower side of the body; and a plurality of rails coupled to the lower side of the body operable to engage a surface for grinding.

2. The grind rail apparatus of claim 1, wherein the plurality of rails extend substantially longitudinally on the lower side of the body.

3. The grind rail apparatus of claim 1, wherein the plurality of rails are further defined as having an upper side, a lower side, and a first and second lateral sides such that the upper side of the plurality of rails are coupled to the lower side of the body.

4. The grind rail apparatus of claim 3, wherein the plurality of rails are further defined as substantially rounded about the lower side of the plurality of rails.

5. The grind rail apparatus of claim 3, wherein the plurality of rails are further defined as substantially flat about the lower side of the plurality of rails.

6. The grind rail apparatus of claim 3, wherein the plurality of rails are further defined as angularly configured about the lower side of the plurality of rails.

7. The grind rail apparatus of claim 1, wherein the flat upper side, the lower side, and the first and second lateral sides of the body define a chamber within the body for retaining a shock absorbing material for cushioning the impact of grinding on a surface.

8. A grind rail apparatus coupled to a footwear for grinding, the grind rail apparatus comprising:

a first member having a substantially flat upper side coupleable to a lower side of the footwear, a lower side provided for grinding, a first lateral side disposed in a substantially perpendicular relationship with the upper side, the first member sized to extend a distance from the lower side of the footwear; and a second member having a substantially flat upper side coupleable to the lower side of the footwear adjacent the first member, the first member sized such that when the lower side of first member engages a surface for grinding the second member extends a distance above the surface, and wherein the first member is further provided with a first angled lateral side extending from the lower side of the first member to the first lateral side of the first member.

9. The grind rail apparatus of claim 8, further comprising:

a third member having a substantially flat upper side coupleable to a lower side of the footwear adjacent the second member, a lower side provided for grinding, a first lateral side disposed in a substantially perpendicular relationship with the upper side, the third member sized to extend a distance from the lower side of the footwear.

10. The grind rail apparatus of claim 9, wherein the third member is further provided with a first angled lateral side angularly extending from the lower side of the third member to the first lateral side of the third member.

11. The grind rail apparatus of claim 8, wherein the first and second members are provided with a front coupleable adjacent a forefoot portion of the lower side of the footwear and a back coupleable adjacent a heel portion of the lower side of the footwear, and wherein the first member is further defined as substantially arcuate between the front and back of the first member and the second member is further defined as substantially arcuate between the front and back of the second member.

12. A grind rail apparatus coupled to a footwear for grinding, the grind rail apparatus comprising:

a first member having a substantially flat upper side coupleable to a lower side of the footwear, a lower side provided for grinding, a first lateral side disposed in a substantially perpendicular relationship with the upper side, the first member sized to extend a distance from the lower side of the footwear;

a second member having a substantially flat upper side coupleable to the lower side of the footwear adjacent the first member, the first member sized such that when the lower side of first member engages a surface for grinding the second member extends a distance above the surface; and a third member having a substantially flat upper side coupleable to a lower side of the footwear adjacent the second member, a lower side provided for grinding, a first lateral side disposed in a substantially perpendicular relationship with the upper side, the third member sized to extend a distance from the lower side of the footwear, and wherein the third member is further provided with a first angled lateral side angularly extending from the lower side of the third member to the first lateral side of the third member.

* * * * *